US011618259B2

(12) United States Patent
Mizuno

(10) Patent No.: US 11,618,259 B2
(45) Date of Patent: Apr. 4, 2023

(54) LIQUID JETTING APPARATUS

(71) Applicant: BROTHER KOGYO KABUSHIKI KAISHA, Nagoya (JP)

(72) Inventor: Taisuke Mizuno, Yokkaichi (JP)

(73) Assignee: BROTHER KOGYO KABUSHIKI KAISHA

( * ) Notice: Subject to any disclaimer, the term of this patent is extended or adjusted under 35 U.S.C. 154(b) by 0 days.

(21) Appl. No.: 17/239,765

(22) Filed: Apr. 26, 2021

(65) Prior Publication Data

US 2021/0237450 A1 Aug. 5, 2021

Related U.S. Application Data

(63) Continuation of application No. 16/432,399, filed on Jun. 5, 2019, now Pat. No. 11,001,064.

(30) Foreign Application Priority Data

Sep. 19, 2018 (JP) ..... JP2018-174606

(51) Int. Cl.
*B41J 2/16* (2006.01)
*B41J 2/165* (2006.01)

(52) U.S. Cl.
CPC ..... *B41J 2/16535* (2013.01); *B41J 2202/12* (2013.01)

(58) Field of Classification Search
CPC ..... B41J 2/16525; B41J 2/17596; B41J 2/16535; B41J 2/175
See application file for complete search history.

(56) References Cited

U.S. PATENT DOCUMENTS

2007/0115317 A1 5/2007 Nishida
2008/0218554 A1 9/2008 Inoue
2008/0238974 A1* 10/2008 Takahashi ..... B41J 2/04596 347/14

(Continued)

FOREIGN PATENT DOCUMENTS

JP 3-277556 A 12/1991
JP 2007-144627 A 6/2007

(Continued)

OTHER PUBLICATIONS

Requirement for Restriction/Election issued in parent U.S. Appl. No. 16/432,399 dated May 13, 2020.

(Continued)

*Primary Examiner* — Jason S Uhlenhake
(74) *Attorney, Agent, or Firm* — Merchant & Gould P.C.

(57) ABSTRACT

A liquid jetting apparatus includes: a liquid jetting head having: a plurality of kinds of individual channels, a jetting surface formed with a plurality of kinds of nozzles from which a plurality of kinds of liquids are jetted, respectively, a plurality of kinds of inflow channels, a plurality of kinds of outflow channels; valves provided at least on the plurality of kinds of inflow channels; a wiper configured to be movable relative to the liquid jetting head in a direction along the jetting surface; a first motor configured to move the liquid jetting head and the wiper relative to each other; and a controller. The controller executes a wiping by driving the first motor in a state that the valves are closed.

20 Claims, 10 Drawing Sheets

(56) References Cited

U.S. PATENT DOCUMENTS

| | | | | |
|---|---|---|---|---|
| 2010/0194801 | A1* | 8/2010 | Hibi | B41J 2/17596<br>347/33 |
| 2010/0321425 | A1 | 12/2010 | Kanke et al. | |
| 2017/0087845 | A1* | 3/2017 | Ogawa | B41J 2/16523 |
| 2017/0197431 | A1* | 7/2017 | Yamada | B41J 2/18 |

FOREIGN PATENT DOCUMENTS

| | | | |
|---|---|---|---|
| JP | 2008-221534 | A | 9/2008 |
| JP | 201105672 | A | 1/2011 |
| JP | 2012-236292 | A | 12/2012 |
| JP | 2017-124609 | A | 7/2017 |

OTHER PUBLICATIONS

Office Action issued in parent U.S. Appl. No. 16/432,399 dated Aug. 17, 2020.

Notice of Allowance issued in parent U.S. Appl. No. 16/432,399 dated Jan. 13, 2021.

Corrected Notice of Allowability issued in parent U.S. Appl. No. 16/432,399 dated Mar. 10, 2021.

Notice of Reasons for Refusal issued in corresponding Japanese Patent Application No. 2018-174606, dated Jun. 14, 2022.

* cited by examiner

LIQUID JETTING APPARATUS

CROSS REFERENCE TO RELATED APPLICATION

The present application is a continuation of U.S. patent application Ser. No. 16/432,399, filed Jun. 5, 2019, now U.S. Pat. No. 11,001,064, which claims priority from Japanese Patent Application No. 2018-174606, filed on Sep. 19, 2018. The disclosures of the aforementioned applications are incorporated herein by reference in their entirety.

BACKGROUND

Field of the Invention

The present disclosure relates to a liquid jetting apparatus which jets liquid from a nozzle.

Description of the Related Art

As a liquid jetting apparatus which jets liquid from nozzles, there is known an ink-jet recording apparatus which performs recording by jetting an ink from nozzles. In this ink-jet recording apparatus, a liquid jetting head is provided with jetting port arrays from which four color inks are jetted, respectively. Further, in the ink-jet recording apparatus, a plurality of internal channels in a plurality of recording element substrates are connected to a common supply channel and a common recovery channel. Further, the ink inflows from the common supply channel into the plurality of internal channels in the plurality of recording element substrates, and the ink flows out from the plurality of internal channels in plurality of recording element substrates to the common recovery channel. The common supply channel and the common recovery channel are connected to a buffer tank. Circulating pumps are connected, respectively, to a location between the common supply channel and the buffer tank and to a location between the common recovery channel and the buffer tank. With this, the ink can be circulated between the buffer tank and the plurality of internal channels in plurality of recording element substrates.

SUMMARY

Here, in the above-described ink-jet recording apparatus, the ink(s) adhered to a jetting surface in which the nozzles (jetting ports) are formed is wiped off by a wiper, in some cases. Since the nozzles from which the four color inks are jetted are formed in the jetting surface in the ink-jet recording apparatus, a mix color ink, in which inks of mutually different colors are mixed in a case that the inks adhered to the jetting surface are wiped by the wiper, enters into an ink channel from the nozzles, in some cases. Since the ink is circulated as described above in the ink-jet recording apparatus, the mix color ink entered from the nozzles moves up to a location separated and away from the nozzles in the inside of the ink channel, in some cases. In such a case, a large amount of the ink needs to be exhausted (discharged) from the nozzles so as to exhaust the mix color ink.

An object of the present disclosure is to provide a liquid jetting apparatus wherein a liquid in which a plurality of kinds of liquids are mixed is less likely to flow into a liquid channel inside a liquid jetting head.

According to an aspect of the present disclosure, there is provided a liquid jetting apparatus including: a liquid jetting head having: a plurality of kinds of individual channels, a jetting surface formed with a plurality of kinds of nozzles, which are communicated with the plurality of kinds of individual channels respectively, and from which a plurality of kinds of liquids being jetted respectively, a plurality of kinds of inflow channels via which the plurality of kinds of liquids inflow into the plurality of kinds of individual channels, respectively, a plurality of kinds of outflow channels via which the plurality of kinds of liquids flow out of the plurality of kinds of individual channels, respectively; valves provided at least on the plurality of kinds of inflow channels, respectively, among the plurality of kinds of inflow channels and the plurality of kinds of the outflow channels; a wiper which is configured to be movable relative to the liquid jetting head in a direction along the jetting surface; a first motor configured to move the liquid jetting head and the wiper relative to each other; and a controller, wherein the controller is configured to execute a wiping by driving the first motor in a state that the valves are closed; and in the wiping, the liquid jetting head and the wiper are moved relative to each other in a state that the wiper makes contact with the jetting surface.

DESCRIPTION OF THE EMBODIMENT

First Embodiment

In the following, a first embodiment of the present disclosure will be explained.

<Overall Configuration of Printer 1>

Figure 1:
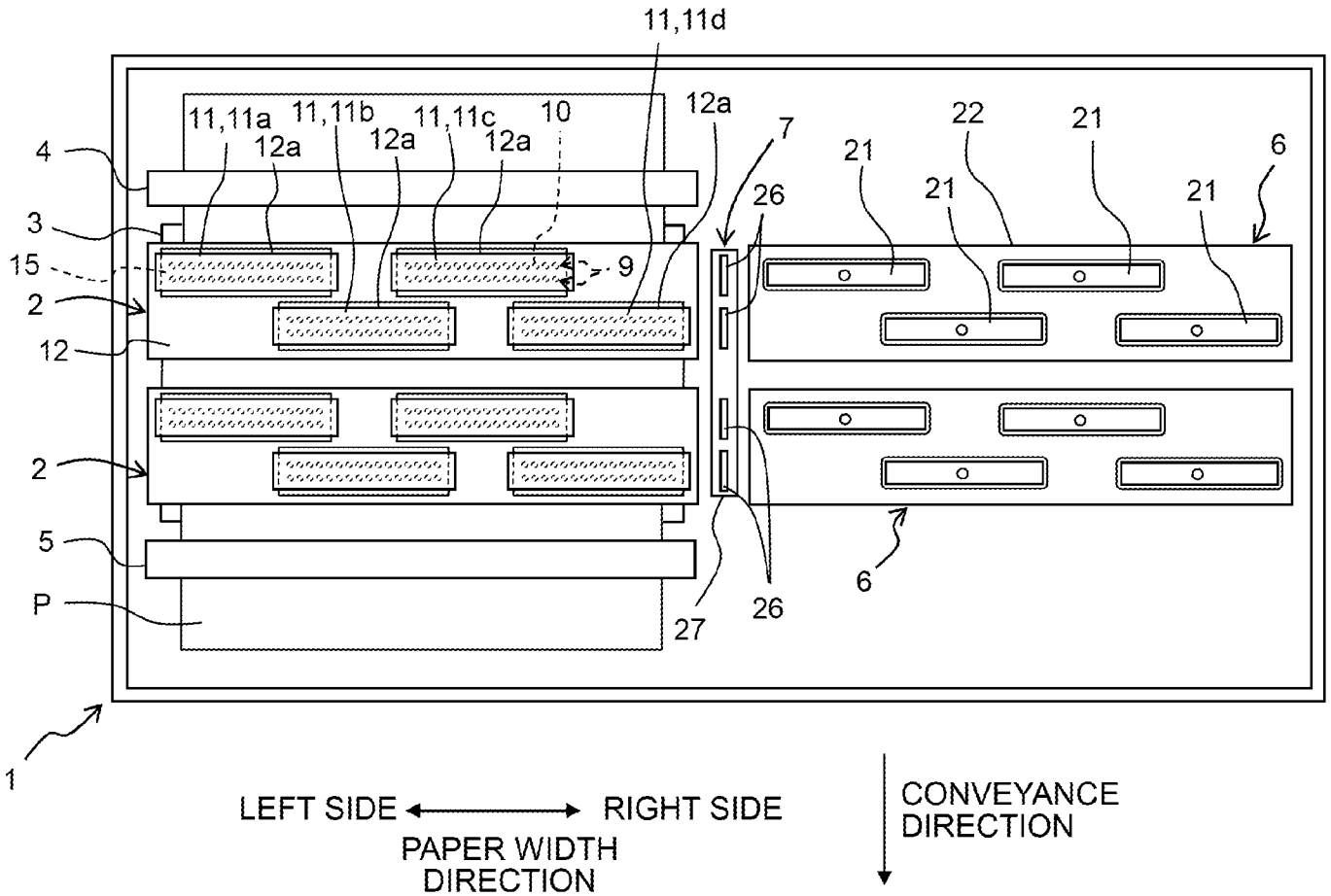
FIG. 1 is a view schematically depicting the configuration of a printer according to a first embodiment of the present disclosure.

As depicted in FIG. 1, a printer 1 according to a first embodiment of the present disclosure is provided with two ink-jet head 2, a platen 3, conveyance rollers 4 and 5, two cap units 6 and a wiper unit 7.

The two ink-jet heads 2 are arranged side by side to each other in a conveyance direction (a "second direction" of the present disclosure). Each of the ink-jet heads 2 is provided with four head units 11 (11*a* to 11*d*) and a holding member 12. Each of the head units 11 jets an ink from a plurality of nozzles 10 formed in a jetting surface 15 which is the lower surface thereof. To provide a more specific explanation, the plurality of nozzles 10 are aligned in a paper width direction (an example of a "first direction" of the present disclosure) which is orthogonal to the conveyance direction to thereby form a nozzle array 9. Each of the head units 11 has two nozzle arrays 9 arranged in the conveyance direction.

In each of the head units 11 constructing an ink-jet head 2 which is included in the two ink-jet heads 2 and which is located on the upstream side in the conveyance direction, a black ink is jetted from nozzles 10 included in the plurality of nozzles 10 and forming a nozzle array 9 which is included in the two nozzle arrays 9 and which is located on the upstream side in the conveyance direction, and a yellow ink is jetted from nozzles 10 included in the plurality of nozzles 10 and forming a nozzle array 9 which is included in the two nozzle arrays 9 and which is located on the downstream side in the conveyance direction. Further, In each of the head units 11 constructing an ink-jet head 2 which is included in the two ink-jet heads 2 and which is located on the downstream side in the conveyance direction, a cyan ink is jetted from nozzles 10 included in the plurality of nozzles 10 and forming a nozzle array 9 which is included in the two nozzle arrays 9 and which is located on the upstream side in the conveyance direction, and a magenta ink is jetted from nozzles 10 included in the plurality of nozzles 10 and forming a nozzle array 9 which is included in the two nozzle arrays 9 and which is located on the downstream side in the conveyance direction.

Note that in the first embodiment, one nozzle array 9 among the two nozzle arrays 9 is an example of a "first nozzle array" of the present disclosure, and an ink jetted from the nozzles 10 constructing this nozzle array 9 is an example of a "first liquid" of the present disclosure; and the other nozzle array 9 among the two nozzle arrays 9 is an example of a "second nozzle array" of the present disclosure, and an ink jetted from the nozzles 10 constructing this nozzle array 9 is an example of a "second liquid" of the present disclosure.

Further, among the four head units 11*a* to 11*d*, two head units 11*a* and 11*c* are arranged side by side in the paper width direction; and two head units 11*b* and 11*d* are arranged side by side in the paper width direction. Furthermore, the head units 11*b* and 11*d* are arranged on the downstream side in the conveyance direction of the head units 11*a* and 11*c*. Moreover, the head units 11*b* and 11*d* are arranged to be shifted to the right side in the paper width direction with respect to the head units 11*a* and 11*c*. With this, in each of the ink-jet heads 2, the plurality of nozzles 10 of the four head units 11 are arranged over the entire length in the paper width direction of a recording paper (recording paper sheet) P. Namely, the ink-jet head 2 is a so-called line head.

The holding member 12 is a plate-shaped member having a rectangular shape of which longitudinal direction is the paper width direction. The holding member 12 is formed with four rectangular through holes 12*a* corresponding to the four head units 11, respectively. The plurality of nozzles 10 of the head units 11 are exposed to the lower side (side of the paper sheet P) from the through holes 12*a*. Further, the holding member 12 is supported to be movable in the paper width direction, and is connected to a head moving motor 66 (see FIG. 4; an example of a "first motor" of the present disclosure), via a non-illustrated gear, etc. In a case that the head moving motor 66 is driven, the ink-jet head 2 including the holding member 12 is moved in the paper width direction.

The platen 3 is arranged at a position below or under the two ink-jet heads 2, extends in the conveyance direction spanning across the two ink-jet heads 2, and faces (is opposite to) the plurality of nozzles 10 of the two ink-jet heads 2. The platen 3 supports the recording paper sheet P from therebelow.

The conveyance roller 4 is located on the upstream side in the conveyance direction with respect to the two ink-jet heads 2 and the platen 3. The conveyance roller 5 is located on the downstream side in the conveyance direction with respect to the two ink-jet heads 2 and the platen 3. The conveyance rollers 4 and 5 are connected to a conveyance motor 67 (see FIG. 4) via non-illustrated gears, etc. In a case that the conveyance motor 67 is driven, the conveyance rollers 4 and 5 are rotated so as to convey the paper sheet P in the conveyance direction.

<Cap Unit 6>

The two cap units 6 correspond to the two ink-jet heads 2, respectively, and are arranged on the right side in the conveyance direction with respect to the two ink-jet heads 2, respectively. Each of the cap units 6 is provided with four caps 21 corresponding to the four head units 11, respectively, and a cap holder 22 which holds the four caps 21.

The cap holder 22 is supported to be movable in the up-down direction, and is connected to a cap ascending/descending motor 23 (see FIG. 4) via a non-illustrated gear, etc. In a case that the cap ascending/descending motor 23 is driven, each of the cap units 6 including the cap holder 22 is moved in the up-down direction. By driving the head moving motor 66 so as to move each of the ink-jet heads 2 up to a position at which the respective head units 11 and the caps 21 corresponding thereto, respectively, face one another, and then by driving the cap ascending/descending motor 23 so as to ascend (lift, move upward) each of the cap units 6, there is provided a cap state wherein the plurality of nozzles 10 of the four head units 11 are covered by the four caps 21, respectively. On the other hand, in a state that the respective cap units 6 are descended (lowered), there is provided an uncap state wherein the plurality of nozzles 10 of the four head units 11 are not covered by the four caps 21. Further, the four caps 21 are connected to a suction pump 24 (see FIG. 4) via a non-illustrated tube, etc. By driving the suction pump 24 in the uncap state, it is possible to discharge (exhaust) an ink accumulated or remained in each of the caps 21 during a purge (to be described later on).

<Wiper Unit 7>

The wiper unit 7 is provided with four wiper 26 arranged side by side to one another in the conveyance direction, and a wiper holder 27 holding the four wipers 26. The four wipers 26 are arranged on the right side in the paper width direction with respect to: the head units 11*a* and 11*c* of the ink-jet head 2 located on the upstream side in the conveyance direction, the head units 11*b* and 11*d* of the ink-jet head 2 located on the upstream side in the conveyance direction, the head units 11*a* and 11*c* of the ink-jet head 2 located on the downstream side in the conveyance direction, and the head units 11*b* and 11*d* of the ink-jet head 2 located on the downstream side in the conveyance direction, respectively. The wiper holder 27 is connected to a wiper ascending/descending motor 28 (see FIG. 4) via a non-illustrated gear, etc., and is movable in the up-down direction. In a case that the wiper ascending/descending motor 28 is driven, the wiper unit 7 including the wiper holder 27 is moved in the up-down direction.

Further, the wiper ascending/descending motor 28 is driven to thereby move the wiper unit 7 until an upper end of each of the wipers 26 is located to be above, to some extent, the jetting surface 15, and then the head moving motor 66 is driven to thereby move the ink-jet heads 2. By doing so, it is possible to perform wiping of moving the wiper 26 and the ink-jet heads 2 relative to each other in the paper width direction in a state that the wiper 26 is allowed to make contact with the jetting surface 15, and thereby wiping an ink adhered to the jetting surface 15 off with the wipers 26.

<Head Unit 11>

Figure 2:
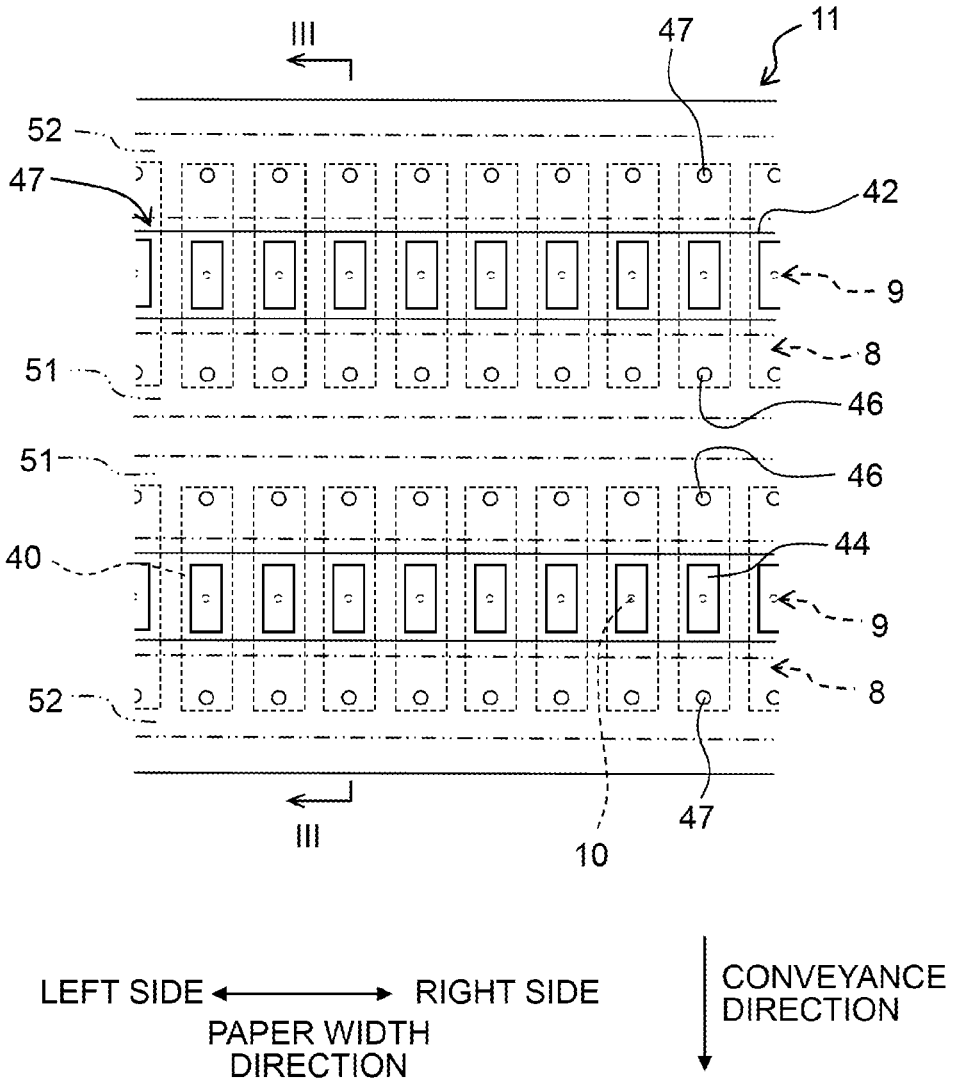
FIG. 2 is a plan view depicting a part of a head unit.
Figure 3:
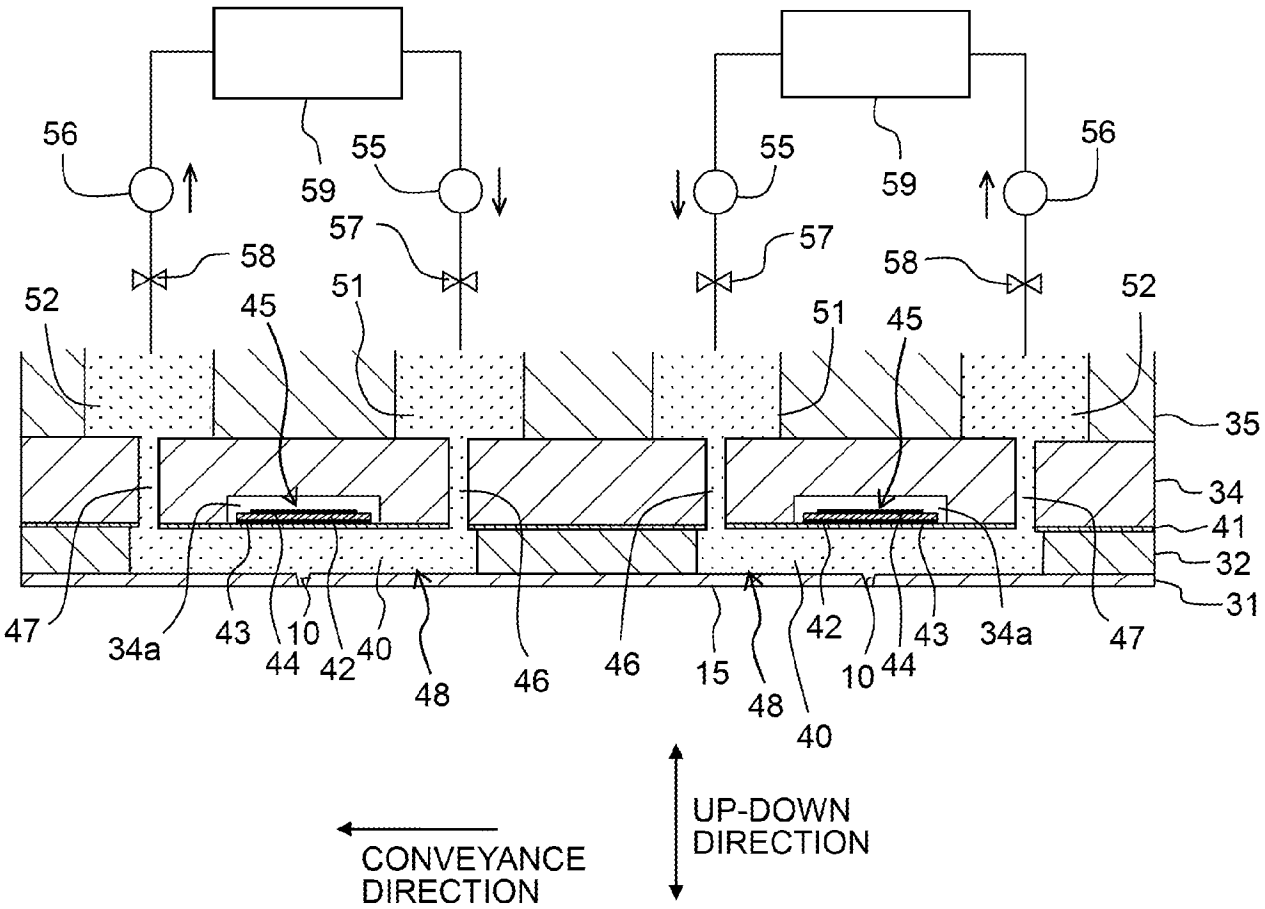
FIG. 3 is a cross-sectional view taken along a line in FIG. 2.

Next, the head units 11 will be explained in detail. As depicted in FIGS. 2 and 3, each of the head units 11 is provide with a nozzle plate 31, a channel substrate 32, a piezoelectric actuator 33, a protective substrate 34 and a channel member 35.

The nozzle plate 31 is formed of a synthetic resin material such as polyimide. The plurality of nozzles 10 are formed in the nozzle plate 31. The plurality of nozzles 10 form the two nozzle arrays 9, as described above. Further, the lower surface of the nozzle plate 31 is the jetting surface 15 of the head unit 11.

The channel substrate 32 is formed of silicon (Si), and is arranged on the upper surface of the nozzle plate 31. The channel substrate 32 is formed with a plurality of pressure chambers 40 corresponding to the plurality of nozzles 10, respectively. Each of the pressure chambers 40 has a shape, which, as projected in the up-down direction, is substantially rectangular wherein the longitudinal direction thereof is the conveyance direction; a central part of each of the pressure chambers 40 overlaps, in the up-down direction, with one of the nozzles 10 corresponding thereto. The channel substrate 32 has two pressure chamber arrays 8 each of which is formed of the plurality of pressure chambers 40 aligned in the paper width direction, and which are arranged side by side in the conveyance direction.

The piezoelectric actuator 33 is provided with a vibration film 41, two piezoelectric films 42, two common electrodes 43 and a plurality of individual electrodes 44.

The vibration film 41 is formed of silicon dioxide ($SiO_2$) or silicon nitride (SiN), and covers the plurality of pressure chambers 40. The vibration film 41 is formed by oxidizing or nitriding a part including the upper surface of the channel substrate 32 which is formed of silicon.

The two piezoelectric films 42 are formed of a piezoelectric material which contains, as a main component thereof, lead zirconate titanate which is a mixed crystal of lead titanate and lead zirconate. The two piezoelectric films 42 correspond to the two pressure chamber arrays 8, respectively. Each of two piezoelectric films 42 extends in the paper width direction over the pressure chambers 40 constructing one of the two pressure chamber arrays 8 corresponding thereto.

The two common electrodes 43 correspond to the two piezoelectric films 42, respectively. Each of the two common electrodes 43 is arranged between one of the piezoelectric films 42 and the vibration film 41, and extends in the conveyance direction over the pressure chambers 40 constructing one of the two pressure chamber arrays 8 corresponding thereto. Each of the common electrodes 43 is always maintained at the ground potential. The plurality of individual electrodes 44 are provided individually for the plurality of pressure chambers 40, respectively. Each of the individual electrodes 44 has a shape which, as projected in the up-down direction, is rectangular wherein the lengths thereof in the paper width direction and the conveyance directions are shorter than those of one of the pressure chambers 40; each of the individual electrodes 44 is arranged in the upper surface of one of the piezoelectric films 42, at a part or portion thereof overlapping, in the up-down direction, with the central part of one of the pressure chambers 40 corresponding thereto. Further, a part or portion, of the piezoelectric actuator 33, which overlaps in the up-down direction with each of the pressure chambers 40 corresponding thereto functions as a driving element 45 configured to apply pressure to the ink inside each of the pressure chambers 40.

The protective substrate 34 is formed of silicon and is arranged in the upper surface of the channel substrate 32 in which the piezoelectric actuator 33 is arranged. The lower surface of the protective substrate 34 is formed with two recessed parts 34*a* corresponding to the two pressure chamber arrays 8, respectively. Each of the recessed parts 34*a* extends in the paper width direction; a plurality of pieces of the driving element 45, which correspond to one of the pressure chamber arrays 8, are accommodated in a space surrounded by each of the recessed parts 34*a* and the channel substrate 32.

Further, a plurality of supply throttle channels 46 are formed in parts of the protective substrate 34 and in parts of the vibration film 41; one of the parts of the protective substrate 34 and one of the parts of the vibration film 41 overlap in the up-down direction with ends on the downstream side (downstream-side ends) in the conveyance direction of the pressure chambers 40 constructing the pressure chamber array 8 on the upstream side in the conveyance direction; and the other of the parts of the protective substrate 34 and the other of the parts of the vibration film 41 overlap in the up-down direction with ends on the upstream side (upstream-side ends) in the conveyance direction of the pressure chambers 40 constructing the pressure chamber array 8 on the downstream side in the conveyance direction. The plurality of supply throttle channels 46 extend in the up-down direction and are arranged side by side to one another in the paper width direction. Furthermore, a plurality of exhaust throttle channels 47 are formed in parts of the protective substrate 34 and in parts of the vibration film 41; one of the parts of the protective substrate 34 and one of the parts of the vibration film 41 overlap in the up-down direction with upstream-side ends in the conveyance direction of the pressure chambers 40 constructing the pressure chamber array 8 on the upstream side in the conveyance direction; and the other of the parts of the protective substrate 34 and the other of the parts of the vibration film 41 overlap in the up-down direction with downstream-side ends in the conveyance direction of the pressure chambers 40 constructing the pressure chamber array 8 on the downstream side in the conveyance direction. The plurality of exhaust throttle channels 47 extend in the up-down direction and are arranged side by side to one another in the paper width direction.

Moreover, in the first embodiment, an individual channel 48 is formed of one piece of (each of) the nozzle 10, one of the pressure chambers 40, one of the supply throttles channel 46 and one of the exhaust throttle channels 47 which correspond to the nozzle 10.

The channel member 35 is formed of a metal material, etc., and is arranged on the upper surface of the protective substrate 34. The channel member 35 is formed with supply manifolds 51 at parts, respectively, of the channel member 35, each of the parts overlapping in the up-down direction with the plurality of supply throttle channels 46; each of the supply manifolds 51 extends in the paper width direction, while spanning over the plurality of supply throttle channels 46. Further, the channel member 35 is formed with exhaust manifolds 52 at parts, respectively, of the channel member 35, each of the parts overlapping in the up-down direction with the plurality of exhaust throttle channels 47; each of the exhaust manifolds 52 extends in the paper width direction, while spanning over the plurality of exhaust throttle channels 47.

Furthermore, each of the supply manifolds 51 is connected to an ink tank 59 via a non-illustrated tube, etc. Moreover, channels each of which is between one of the supply manifolds 51 and the ink tank 59 are provided with supply side pumps 55, respectively. Each of the supply side pumps 55 feeds the ink in a direction from the ink tank 59 toward one of the supply manifolds 51. Note that a channel formed by combining each of the supply manifolds 51 and the channel connecting each of the supply manifolds 51 and the ink tank 59 in the first embodiment is an example of a "inflow channel" of the present disclosure.

Further, each of the exhaust manifolds 52 is connected to the ink tank 59 via a non-illustrated tube, etc. Furthermore, channels each of which is between one of the exhaust manifolds 52 and the ink tank 59 are provided with exhaust side pumps 56. Each of the exhaust side pumps 56 feeds the ink selectively in either one of a direction from one of the exhaust manifolds 52 toward the ink tank 59 and a direction from the ink tank 59 toward one of the exhaust manifolds 52. Note that a channel formed by combining each of the exhaust manifolds 52 and the channel connecting each of the exhaust manifolds 52 and the ink tank 59 in the first embodiment is an example of a "outflow channel" of the present disclosure.

Further, the ink tank 59 is connected to a non-illustrated ink cartridge via a non-illustrated tube, etc., and the ink is supplied from the ink cartridge to the ink tank 59. Furthermore, the ink tank 59 is located at a position over or above the head unit 11 by approximately tens of mm.

Moreover, the channels each of which is between one of the supply manifolds 51 and one of the supply side pumps 55 are provided with supply side valves 57, respectively. In a state that the supply side valves 57 are opened, the supply manifolds 51 and the supply side pumps 55 are communicated with one another, respectively. In a state that the supply side valves 57 are closed, the communications each between one of the supply manifolds 51 and one of the supply side pumps 55 are shut off (closed).

Further, the channels each of which is between one of the exhaust manifolds 52 and one of the exhaust side pumps 56 are provided with exhaust side valves 58, respectively. In a state that the exhaust side valves 58 are opened, the exhaust manifolds 52 and the exhaust side pumps 56 are communicated with one another, respectively. In a state that the exhaust side valves 58 are closed, the communications each between one of the exhaust manifolds 52 and one of the exhaust side pumps 56 are shut off (closed).

Each of the valves 57 and 58 is, for example, an electromagnetic valve. In the present embodiment, the opening/closing of each of the valves 57 and 58 is switched at a time of maintenance, as will be described later on. Further, owing to the provision of the valves 57 and 58, for example, it is possible to prevent the air from entering into the head unit 11, etc., in a case that the power source of the printer 1 is switched OFF, by closing the valves 57 and 58. Further, it is possible to prevent the air from entering into the head unit 11, etc., in a case, for example, that the head unit 11 is exchanged due to any malfunction, etc., by closing the valves 57 and 58.

<Electrical Configuration of Printer 1>

Figure 4:
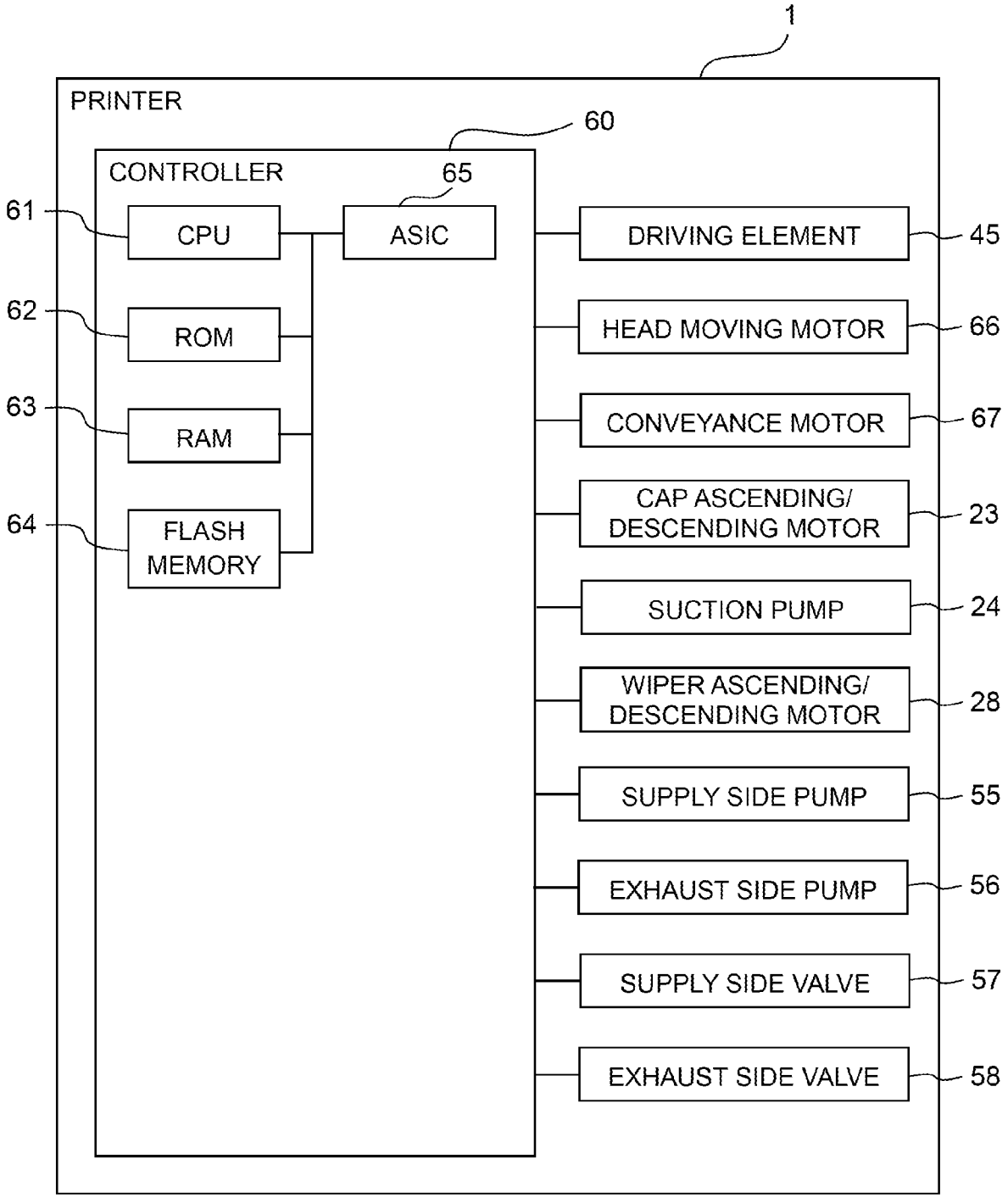
FIG. 4 is a block diagram depicting the electrical configuration of the printer.

Next, the electrical configuration of the printer 1 will be explained. Here, the operations of the printer 1 is controlled by the controller 60. As depicted in FIG. 4, the controller 60 is constructed of a CPU (Central Processing Unit) 61, a ROM (Read Only Memory) 62, a RAM (Random Access Memory) 63, a flash memory 64, an ASIC (Application Specific Integrated Circuit) 65, etc. The controller 60 controls the operations of the driving elements 45, the head moving motor 66, the conveyance motor 67, the cap ascending/descending motor 23, the suction pump 24, the wiper ascending/descending motor 28, the supply side pumps 55, the exhaust side pumps 56, the supply side valves 57, the exhaust side valves 58, etc.

Note that in the controller 60, only the CPU 61 may perform the variety of kinds of processing, or only the ASIC 65 may perform the variety of kinds of processing, or the CPU 61 and the ASIC 65 may perform the variety of kinds of processing in cooperation. Alternatively, in the controller 60, one piece of the CPU 61 may solely perform the variety of kinds of processing, or a plurality of pieces of the CPU 61 may perform the variety of kinds of processing in sharing manner. Still alternatively, in the controller 60, one piece of the ASIC 65 may solely perform the variety of kinds of processing, or a plurality of pieces of the ASIC 65 may perform the variety of kinds of processing in sharing manner.

<Control During Circulation>

In the printer 1, the ink is circulated between the ink tank 59 and the head unit 11. In order to circulate the ink between the ink tank 59 and the head unit 11, the controller 60 drives each of the supply side pumps 55 so that the ink is fed in a direction from the ink tank 59 toward the supply manifold 51, and drives each of the exhaust side pumps 56 so that the ink is fed from the exhaust manifold 52 toward the ink tank 59. Note that in FIG. 3, arrows placed with respect to the supply side pumps 55 and the exhaust side pumps 56 indicate, respectively, directions in which the inks are fed during the circulation.

Then, the ink inside the ink tank 59 inflows into each of the plurality of pressure chambers 40 via the supply manifold 51 and one of the plurality of supply throttle channels 46. Further, the ink in each of the plurality of pressure chambers 40 outflows (flows out) to the ink tank 59 via one of the plurality of exhaust throttle channels 47 and the exhaust manifold 52. With this, the ink circulates between the ink tank 59 and the head unit 11. Note that in a case of circulating the ink between the ink tank 59 and the head unit 11, the above-described uncap state is provided.

In this situation, the supply side pumps 55 operate as positive pressure pumps each configured to impart positive pressure to a part, of the channel connecting the ink tank 59 with one of the supply manifolds 51, which is located on the side of the ink tank 59 (on the side opposite to the individual channel 48) with respect to one of the supply side valves 57. Further, the exhaust side pumps 56 operate as negative pressure pumps each configured to impart negative pressure to a part, of the channel connecting the ink tank 59 with one of the exhaust manifolds 52, which is located on the side of the ink tank 59 (on the side opposite to the individual channel 48) with respect to one of the exhaust side valves 58. Furthermore, in this situation, the controller 60 controls the supply side pumps 55 and the exhaust side pumps 56 so that the pressure in the ink inside each of the nozzles 10 becomes the negative pressure.

<Control During Recording>

Further, in the printer 1, the controller 60 drives the driving elements 45 of the head unit 11 so as to jet the ink from the nozzles 10, while driving the conveyance motor 67 so as to cause the conveyance rollers 4 and 5 to convey the recording paper sheet P in the conveyance direction, thereby performing recording on the recording paper sheet P.

In this situation, the controller 60 outputs a signal of a driving waveform to a certain individual electrode 44, among the plurality of individual electrodes 44, so as to switch the potential of the certain individual electrode 44, between the ground potential and a predetermined driving potential (for example, about 20V), and to drive a certain driving element 45, among the plurality of driving elements 45, corresponding to the certain individual electrode 44. In this situation, the parts of the vibration film 41 and the piezoelectric film 42 overlapping, in the up-down direction, with a certain pressure chamber 40, among the plurality of pressure chambers 40 and corresponding to the certain driving element 45, are deformed to thereby change the pressure in the ink inside the certain pressure chamber 40, which in turn causes the ink to be jetted from a certain nozzle 10, among the plurality of nozzles 10 and corresponding to the certain pressure chamber 40. Further, in this situation, the controller 60 outputs selectively any one of a plurality of kinds of driving waveform so as to cause the head unit 11 to selectively jet, from the certain nozzle 10, any one of a big dot (drop), a medium dot (drop) and a small dot (drop) of which volumes are mutually different.

<Control During Maintenance>

Next, an explanation will be given about the control in a case of performing maintenance for the head unit 11 in the printer 1. In the printer 1, the maintenance is performed in such a case that the viscosity of the ink inside the head unit 11 is increased, etc. Note that in the printer 1, it is possible to perform the maintenance as explained below individually for each of the head units 11.

Figure 5:
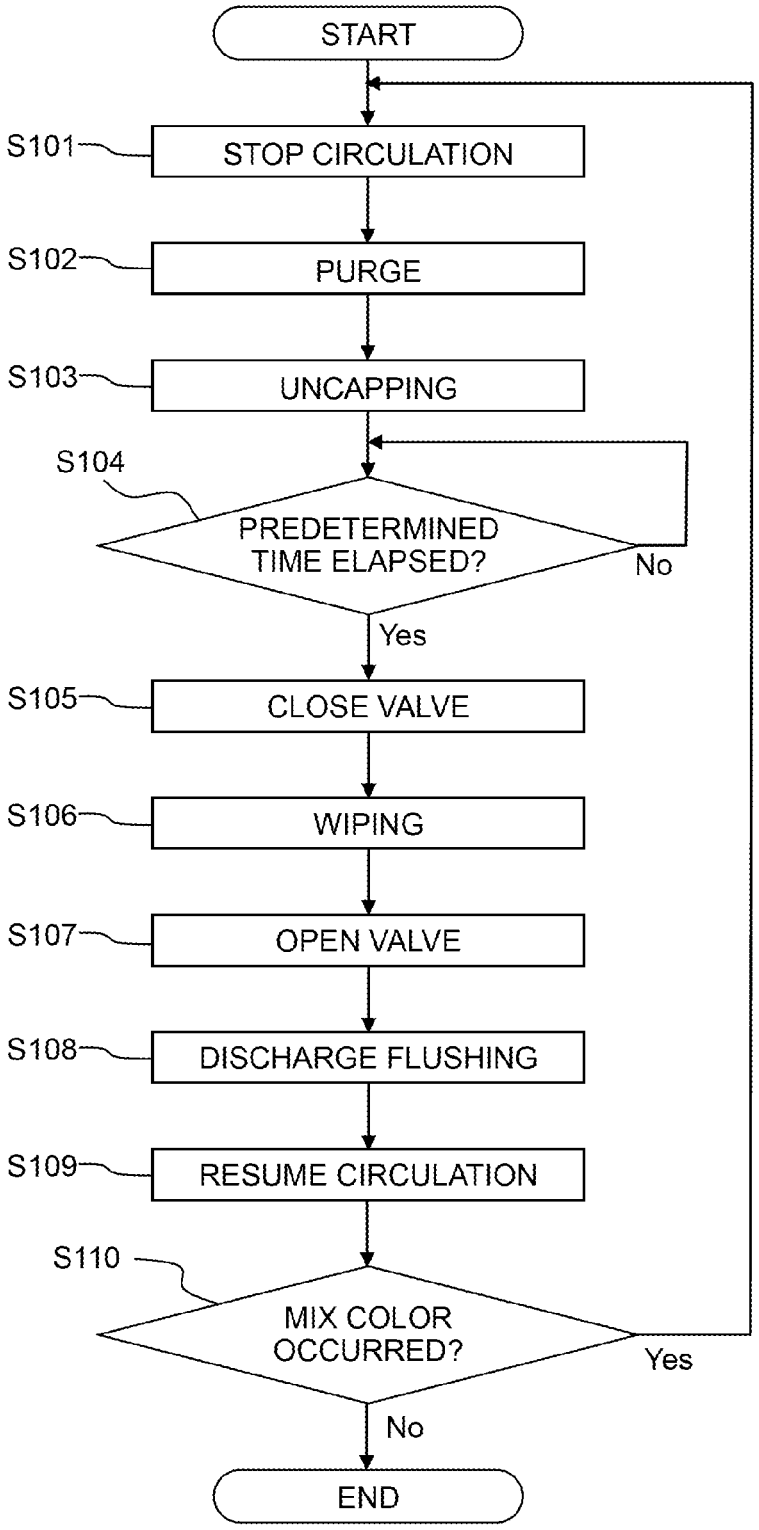
FIG. 5 is a flow chart depicting a flow of a processing in a case of performing maintenance in the first embodiment.

In a case that the maintenance is performed for the head unit 11 in the printer 1, the controller 60 performs the processing in accordance with the flow depicted in FIG. 5. To provide a more specific explanation, the controller 60 firstly stops the circulation of the ink between each of the ink tanks 59 and the head unit 11 (S101). Specifically, the controller 60 stops the driving of the supply side pumps 55 and the driving of the exhaust side pumps 56.

Next, the controller 60 perform control to execute the purge (S102). To provide a more specific explanation, the controller 60 drives the head moving motor 66 and the cap ascending/descending motor 23 so as to provide the above-described cap state, the controller 60 then drives each of the supply side pumps 55 such that the ink is fed in a direction from the ink tank 59 toward the supply manifold 51, and drives each of the exhaust side pumps 56 such that the ink is fed in a direction from the ink tank 59 toward the exhaust manifold 52.

Then, the purge is performed whereby the pressure in the ink inside the channels included in the head unit 11 (the nozzles 10, the pressure chambers 40, etc.) is increased and the ink inside the head unit 11 is exhausted (discharged) from the nozzles 10. Note that a combination of the supply side pumps 55 and the exhaust side pumps 56 in the first embodiment is an example of a "purge mechanism" of the present disclosure.

After the completion of the purge, the controller 60 drives the cap ascending/descending motor 23 so as to provide the above-described uncap state (S103). Afterwards, the controller 60 stands by until a predetermined time elapses (S104: NO). In a case that the pumps 55 and 56 are stopped by the completion of the purge and the uncap state is provided, the pressure in the ink inside the nozzles 10 becomes the positive pressure due to the difference in the water head pressure, between the ink inside the ink tank 59 and the ink inside the nozzles 10, since the ink tank 59 is located at the position above the head unit 11 (nozzles 10). The predetermined time is a time required for the pressure inside the nozzles 10 is stabilized after the uncap state has been provided in step S102; the predetermined time is, for example, about 1 second.

After the predetermined time has elapsed (S104: YES), the controller 60 closes all the supply side valves 57 and the exhaust side valves 58 corresponding to each of the nozzle arrays 9 in the head unit 11 (S105), and then the controller 60 performs control to execute the above-described wiping (S106). With this, the wiping is performed in the state that the pressure in the ink inside the nozzles 10 becomes the positive pressure.

Next, the controller 60 opens all the supply side valves 57 and the exhaust side valves 58 corresponding to each of the nozzle arrays 9 in the head unit 11 (S107), and then the controller 60 performs control to execute a discharge flushing for driving the driving elements 45 to thereby exhaust (discharge) the ink from the nozzles 10 (S108). With this, the discharge flushing is performed in a state that the pressure in the ink inside the nozzles 10 becomes the positive pressure. Further, in this situation, the controller 60 outputs the driving waveform for jetting the above-described large drop from the nozzles 10. Furthermore, in the discharge flushing, the controller 60 causes the ink to be jetted in a volume not less than half the volume of a sphere of which diameter is same as diameter of each of the nozzles 10. Moreover, note that in the case of performing the above-described discharge flushing, the above-described uncap state is provided.

Then, after the completion of the discharge flushing, the controller 60 drives the supply side pumps 55 and the exhaust side pumps 56 so as to resume the circulation of the ink between the ink tanks 59 and the head unit 11 (S109). Then, the controller 60 determines as to whether or not there is any possibility that any mix color ink (an example of "mix liquid" of the present disclosure) in which the plurality of color inks are mixed has inflowed from the nozzles 10 into the individual channels 48 (S110). Although a method for performing the determination in step S110 is not particularly limited, for example, in such a case that a sensor configured to detect vibration is provided on the printer 1 and that the vibration is detected by the above-described sensor after the purge in Step S102 and before the completion of the discharge flushing, the controller 60 determines that there is a possibility that the mix color ink has inflowed into the individual channels 48.

Further, in a case that the controller 60 determines that there is not such a possibility that the mix color ink has inflowed into the individual channels 48 (S110: NO), the controller ends the processing. On the other hand, in a case that the controller 60 determines that there is such a possibility that the mix color ink has inflowed into the individual channels 48 (S110: YES), the controller 60 returns the processing to step S101 and performs the control to execute the purge, the wiping and the discharge flushing again.

<Effects>

In the first embodiment, in a case that the purge is performed, the ink adheres to the jetting surface 15. In view of this, in the present disclosure, the wiping is performed after the purge to thereby wipe off the ink adhered to the jetting surface 15. In this situation, since the wiping is performed in the state that the circulation of the ink is stopped and that the supply side valves 57 and the exhaust side valves 58 are closed, the mix color ink in which the plurality of color inks are mixed is less likely to flow from the nozzles 10 toward the pressure chambers 40 of the individual channels 48 during the wiping.

Further, in the first embodiment, since the discharge flushing is performed by opening the supply side valves 57 and the exhaust side valves 58, after performing the wiping. Thus, it is possible to exhaust the mix color ink, which has entered into the inside of the nozzles 10 during the wiping, from the nozzles 10.

Furthermore, in the first embodiment, the wiping is performed in a state that all the two supply side valves 57 and the two exhaust side valves 58 corresponding to the two nozzle arrays 9, respectively, of the head unit 11 are closed. Accordingly, in any of the nozzles 10 constructing the two nozzle arrays 9 in the head unit 11, the mix color ink is less likely to flow into the individual channels 48.

Moreover, in the first embodiment, the plurality of nozzles 10 constructing each of the nozzle arrays 9 are aligned in the paper width direction, whereas the wiping is performed while moving the ink-jet head 2 and the wiper unit 7 relative to each other in the paper-width direction. Accordingly, during the wiping, it is possible to make a situation that the plurality of color inks adhering to the jetting surface 15 are mixed with one another to be less likely to occur.

Further, in the first embodiment, the wiping is performed in the state that the pressure in the ink inside the nozzles 10 are allowed to be the positive pressure. By allowing the pressure in the ink inside the nozzles 10 to be the positive pressure, the meniscus of the ink inside each of the nozzles 10 projects downward from the jetting surface 15. Then, by performing the wiping in this state, it is possible to effectively wipe the ink adhered to the jetting surface 15.

Furthermore, in the first embodiment, each of the ink tanks 59 is located at the position above the ink-jet head 2. Accordingly, it is possible to make the pressure in the ink inside the nozzles 10 to be the positive pressure due to the difference in the water head pressure between the ink inside the ink tank 59 and the ink inside the nozzles 10, by stopping the supply side pumps 55 and the exhaust side pumps 56 and by opening the supply side valves 57 and the exhaust side valves 58, after the completion of the purge.

On the other hand, during the circulation, it is possible to prevent the ink from leaking from the nozzles 10 even if any variation to some extent occurs in the pressure in the ink inside the nozzles 10, by controlling the supply side pumps 55 and the exhaust side pumps 56 to thereby make the pressure in the ink inside the nozzles 10 to be the negative pressure.

Moreover, in the first embodiment, the discharge flushing is performed in the state that the pressure in the ink inside the nozzles 10 is allowed to be the positive pressure. In a case that the pressure in the ink inside the nozzles 10 is allowed to be the positive pressure, the meniscus of the ink inside each of the nozzles 10 projects downward from the jetting surface 15. Then, by performing the discharge flushing in this state, it is possible to efficiently discharge (exhaust) the mix color ink inside the nozzles 10.

Further, during the wiping, the volume of the ink projecting downward from each of the nozzles 10 is smaller than half the volume of the sphere of which diameter is same as diameter of each of the nozzles 10. Accordingly, the volume of the ink flowing into each of the nozzles 10 during the wiping is smaller than the above-described volume. Therefore, in the discharge flushing, by discharging, from each of the nozzles 10, the ink in a volume not less than half the volume of the above-described sphere, it is possible to exhaust the mix color ink from each of the nozzles 10 assuredly.

Furthermore, in the first embodiment, during the recording on the recording paper sheet P, the ink is jetted from the nozzles 10 selectively as either one of the three kinds of inks which are the large drop, the medium drop and the small drop having the mutually different volumes; whereas in the discharge flushing, the large drop which is the largest among the three drops is jetted. With this, the number of times of discharge from each of the nozzles 10 during the discharge flushing can be made small. Moreover, in the discharge flushing, by discharging the large drop of which volume is larger than those of the medium and small drops, the mix color ink can be exhausted from each of the nozzles 10 assuredly.

Further, in the pressure chamber 40, during the circulation of the ink, the ink flows in the pressure chamber 40 from the side of the supply throttle channel 46 toward the side of the exhaust throttle channel 47 in the conveyance direction. Accordingly, the ink flowing out of the nozzle 10 is likely to flow on the jetting surface 15 from the side of the supply throttle channel 46 toward the side of the exhaust throttle channel 47 in the conveyance direction.

In view of this situation, in the first embodiment, the supply throttle channels 46 corresponding to the nozzle array 9 on the upstream side in the conveyance direction are located at a position which is on the downstream side in the conveyance direction with respect to the exhaust throttle channels 47 corresponding to this nozzle array 9. Further, the supply throttle channels 46 corresponding to the nozzle array 9 on the downstream side in the conveyance direction are located at a position which is on the upstream side in the conveyance direction with respect to the exhaust throttle channels 47 corresponding to this nozzle array 9.

With this, the ink flowing out from the nozzles 10 constructing the nozzle array 9 on the upstream side in the conveyance direction is likely to flow in a direction separating away from the nozzles 10 constructing the nozzle array 9 on the downstream side in the conveyance direction. Further, the ink flowing out from the nozzles 10 constructing the nozzle array 9 on the downstream side in the conveyance direction is likely to flow in a direction separating away from the nozzles 10 constructing the nozzle array 9 on the upstream side in the conveyance direction. With these configurations, the inks flowing out from the nozzles 10 and having mutually different colors are less likely to mix with each other.

Further, in the first embodiment, in such a case that there is a possibility that the mix color ink has inflowed into the individual channels 48 after the purge performed in step S102, it is possible to exhaust the mix color ink inside the individual channels 48 by performing the purge again. Furthermore, in this situation, since the purge is performed in the state that both of the supply side valves 57 and the exhaust side valves 58 are opened, it is possible to exhaust the mix color ink inside the individual channels 48 assuredly.

Moreover, such a case is considered, unlike in the first embodiment, of performing a so-called suction purge in which the suction pump 24 is driven in a state that the plurality of nozzles 10 of the head unit 11 are covered by the cap 21 to thereby exhaust the ink inside the head unit 11 from the nozzles 10. In such a case, it is necessary, for example, to provided caps individually for the nozzle arrays 9, respectively, or to provide, to the cap, a partition wall for partitioning of areas corresponding to the nozzle arrays 9, respectively, in order to exhaust the inks of respective colors each at a desired amount. In these cases, it is necessary to make the spacing distance in the conveyance direction between the nozzle arrays 9 to be large, which in turn leads to a large-sized ink-jet head.

In contrast, in the first embodiment, since the purge is performed by driving the supply side pumps 55 and the exhaust side pumps 56, the caps 21 can be configured to cover all the nozzles 10 of the head units 11 together. With this, in the head unit 11, the nozzle arrays 9 can be arranged closely to each other in the conveyance direction, thereby making it possible to suppress any increase in the size of the ink-jet head 2.

Second Embodiment

Next, a second embodiment of the present disclosure will be explained. Note, however, that the second embodiment is similar to the first embodiment, except for the configuration of the head unit, etc. Thus, the following explanation therefor will be given only regarding a part or portion of the second embodiment different from that of the first embodiment.

Figure 6:
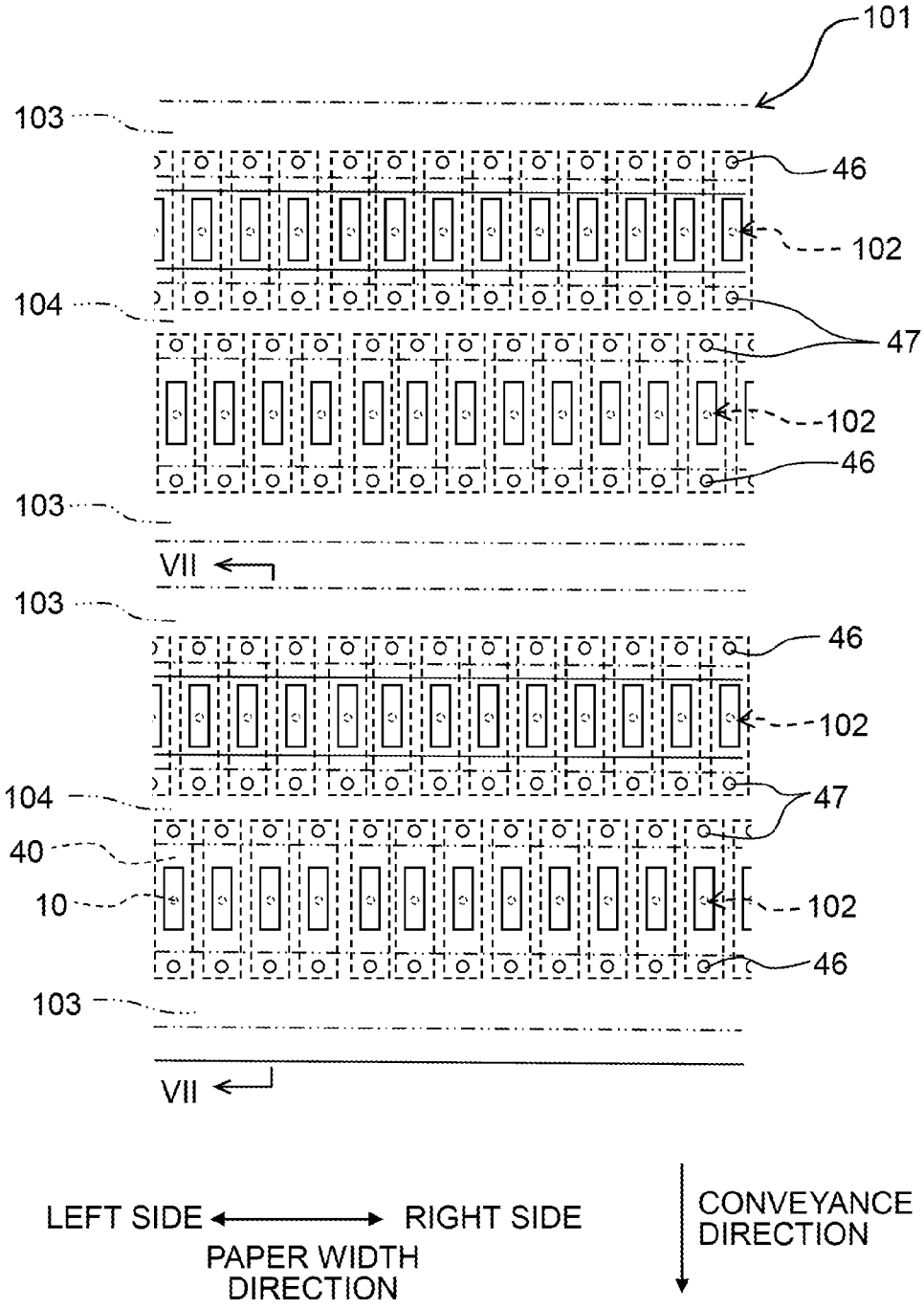
FIG. 6 is a plan view depicting a part of a head unit according to a second embodiment.
Figure 7:
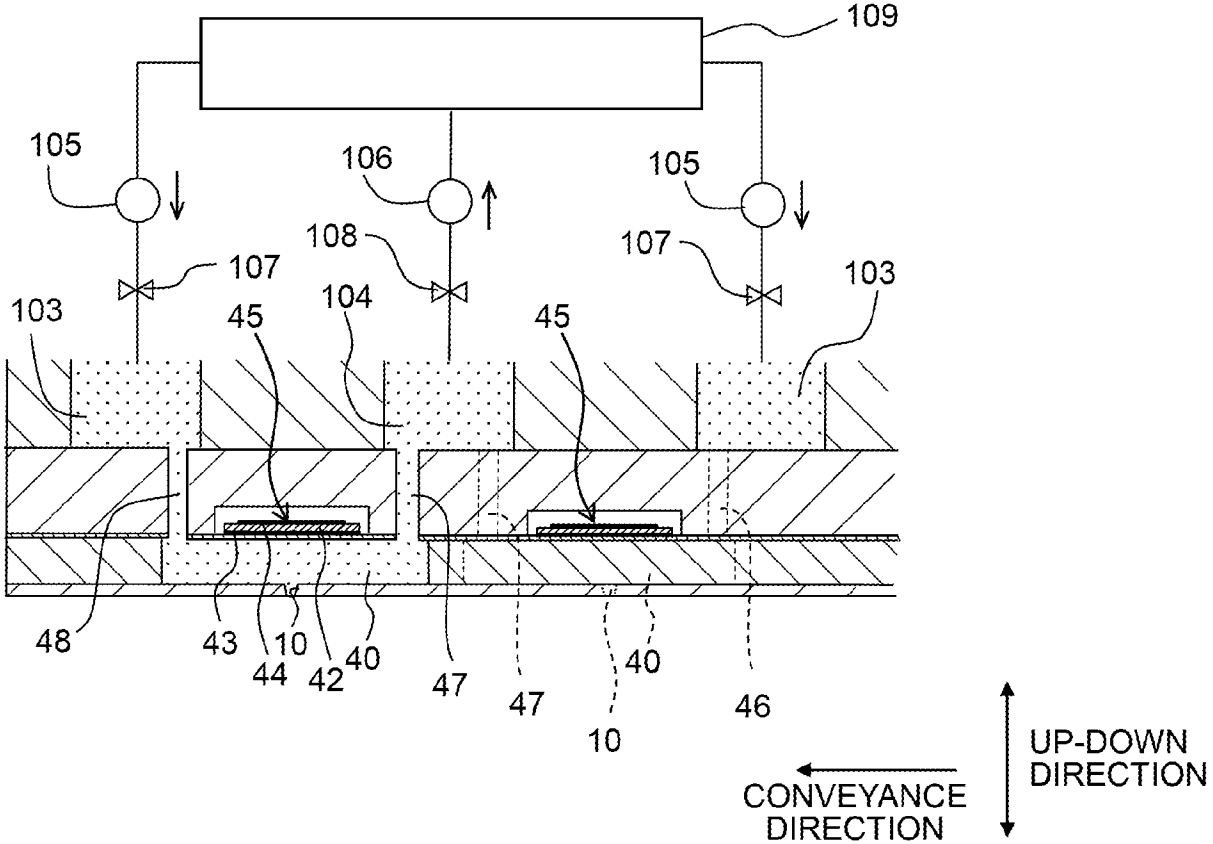
FIG. 7 is a cross-sectional view taken along a line VII-VII in FIG. 6.

As depicted in FIGS. 6 and 7, in the second embodiment, nozzles 10 which jet a plurality of color inks, respectively, are aligned in the paper width direction so as to form, in the head unit 101, two nozzle arrays 102 which are arranged side by side to each other in the conveyance direction. Further, between these two nozzle arrays 102, the positions of the nozzles 10 in the paper width direction are shifted only by a length half the spacing distance of the nozzles 10 in each of the nozzle arrays 102. In the second embodiment, among the two nozzle arrays 102 jetting the plurality of color inks, respectively, one of the nozzle arrays 102 is an example of the "first nozzle array" of the present disclosure, and the other of the nozzle arrays 102 is an example of the "second nozzle array" of the present disclosure.

Furthermore, in the head unit 101, the parts or the portions which are different from the nozzles 10 of the individual channels 48 (the pressure chambers 40, the driving elements 45, the supply throttle channels 46 and the exhaust throttle channels 47) are arranged in accordance with the above-described arrangement of the nozzles 10.

Note that, however, in the second embodiment, supply throttle channels 46 and exhaust throttle channels 47, corresponding to a nozzle array 102 which is included in the two nozzle arrays 102 and which is located on the upstream side in the conveyance direction, overlap, in the up-down direction, with ends on the upstream side (upstream-side ends) on the conveyance direction and ends on the downstream side (downstream-side ends) in the conveyance direction, respectively, of the pressure chambers 40. On the other side, supply throttle channels 46 and exhaust throttle channels 47, corresponding to a nozzle array 102 which is included in the two nozzle arrays 102 and which is located on the downstream side in the conveyance direction, overlap, in the up-down direction, with downstream-side ends in the conveyance direction and upstream-side ends in the conveyance direction, respectively, of the pressure chambers 40.

Further, in the second embodiment, supply manifolds 103 are arranged at locations, respectively, which are above a plurality of pieces of the supply throttle channel 46 corresponding to the nozzle arrays 102, respectively, while extending over the plurality of pieces of the supply throttle channel 46. Furthermore, in the second embodiment, one exhaust manifold 104 is arranged at a location which is above the plurality of pieces of the exhaust throttle channel 47 corresponding to two nozzle arrays 102, while extending over the plurality of pieces of the exhaust throttle channel 47 corresponding to the two nozzle arrays 47. Namely, in the second embodiment, the one exhaust manifold 104 which is common to the two nozzle arrays 102 is provided between, in the conveyance direction, the two supply manifolds 103 which correspond to the two nozzle arrays 102, respectively.

Moreover, in the second embodiment, each of the supply manifolds 103 and the exhaust manifold 104 are connected to an ink tank 109. Supply side pumps 105 are provided on channels, respectively, each of which is between the ink tank 109 and one of the supply manifolds 103, and an exhaust side pump 106 is provided on a channel which is between the ink tank 109 and the exhaust manifold 104. Further, supply side valves 107 are provided on channels, respectively, each of which is between one of the supply side pump 105 and one of the supply manifolds 103, and an exhaust side valve 108 is provided on a channel which is between the exhaust side pump 106 and the exhaust manifold 104. In the second embodiment, one of the supply manifolds 103 corresponding to the one of the nozzle arrays 102 (first nozzle array) is an example of a "first inflow channel" of the present disclosure, and the other of the supply manifolds 103 corresponding to the other of the nozzle arrays 102 (second nozzle array) is an example of a "second inflow channel" of the present disclosure; and the exhaust manifold 104 is an example of an "outflow channel" of the present disclosure.

<Control During Circulation>

In the second embodiment, in a case of circulating the ink between the ink tank 109 and the head unit 11, the controller 60 drives the supply side pumps 105 so as to feed the ink in a direction from the ink tank 109 toward each of the supply manifolds 103, and drives the exhaust side pump 106 so as to feed the ink in a direction from the exhaust manifold 104 toward the ink tank 109. Further, in this situation, the controller 60 controls the supply side pumps 105 and the exhaust side pump 106 so that the pressure in the ink inside each of the nozzles 10 becomes the negative pressure.

Then, the ink inside the ink tank 109 inflows into the plurality of pressure chambers 40 via the supply manifolds 103 and the plurality of supply throttle channels 46. Further, the ink inside the plurality of pressure chambers 40 flow out toward the ink tank 109 via the plurality of exhaust throttle channels 47 and the exhaust manifold 104. With this, the ink circulates between the ink tank 109 and the head unit 101.

<Control During Maintenance>

Figure 8:
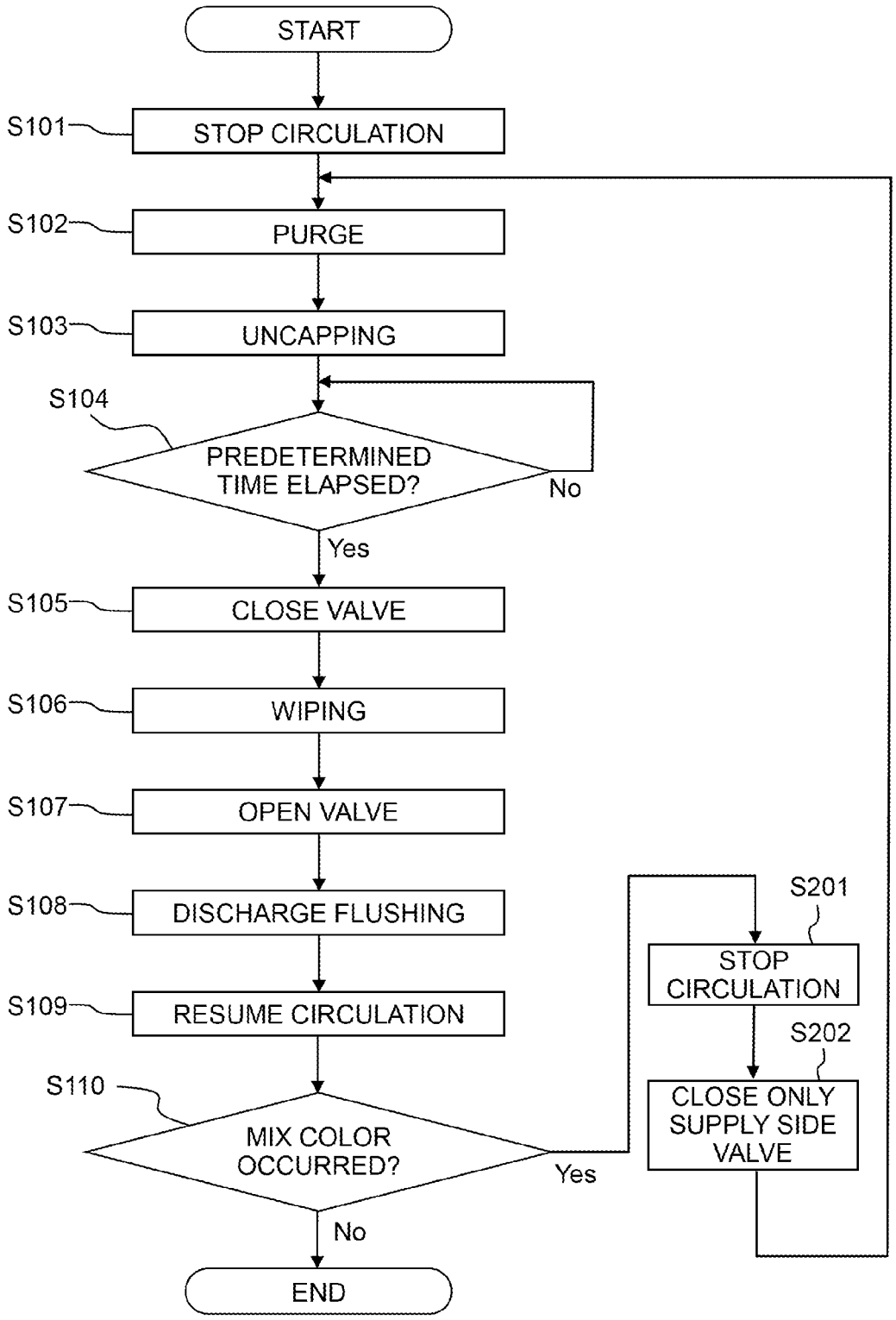
FIG. 8 is a flow chart depicting a flow of a processing in a case of performing maintenance in the second embodiment.

In a case that maintenance is performed in the second embodiment, the controller 60 performs the processing in accordance with a flow depicted in FIG. 8. To provided more specific explanation, during the maintenance, the controller 60 performs the processing in each of the S101 to S110 which are similar to those in the first embodiment. Note, however, that in the purge in step S102 of the second embodiment, the controller 60 drives the supply side pumps 105 so that the ink is fed in the direction from the ink tank 109 toward each of the supply manifolds 103, and drives the exhaust side pump 106 so that the ink is fed in a direction from the ink tank 109 toward the exhaust side manifold 104. Further, in step S105, the controller 60 closes all of the supply side valves 107 and the exhaust side valve 108 corresponding to the respective nozzle arrays 102 in the head unit 101. Furthermore, in step S107, the controller 60 opens all of the supply side valves 107 and the exhaust side valve 108 corresponding to the respective nozzle arrays 102 in the head unit 101.

Furthermore, in the second embodiment, after the controller 60 performs the discharge flushing in step S108, the controller 60 resumes the circulation (S109), similarly to the first embodiment. Then, in a case that the controller 60 determines that there is not such a possibility that the mix color ink has inflowed into the individual channels 48 (S110: NO), the controller ends the processing. On the other hand, in a case that the controller 60 determines that there is such a possibility that the mix color ink has inflowed into the individual channels 48 (S110: YES), the controller 60 stops the circulation (S201); then, the controller 60 closes the supply side valves 107 of the head unit 101 while allowing the exhaust side valve 108 to be opened (S202), and then controller returns the procedure to step S102 and performs control to execute the purge again.

Note that since the control during the recording in the second embodiment is same as that in the first embodiment, any explanation therefor will be omitted here.

[Effects]

Also in the second embodiment, in such a case that there is a possibility that the mix color ink has inflowed into the individual channels 48 after the purge performed in step S102, it is possible to exhaust the mix color ink inside the individual channels 48 by performing the purge again.

In a case that the circulation is resumed in step S109, the mix color ink inflowed from each of the nozzles 10 toward the pressure chamber 40 is likely to remain in a part, of the individual channel 48, which is on the side of the exhaust-throttle channel 47 due to a flow generated by the circulation, rather than in another part which is on the side of the nozzle 10. In view of this, in the second embodiment, in the case that there is a possibility that the mix color ink has inflowed into the individual channels 48, the purge is performed again in a state that the exhaust side valve 108 is allowed to be opened while the supply side valves 107 are closed. With this, it is possible to exhaust the mix color ink inside the individual channels 48 assuredly, and it is possible to make an amount of the ink to be exhausted from the head unit 101 for the purpose of exhausting the mix color ink to be small, as compared with a case of performing the purge again in a state that both of the supply side valves 107 and the exhaust side valve 108 are opened.

Also in the second embodiment, since the purge is performed by driving the supply side pumps 105 and the exhaust side pump 106, thereby making it possible to arrange the nozzle arrays 102 closely to each other in the conveyance direction, and thus to suppress any increase in the size of the ink-jet head 2, similarly as explained regarding the first embodiment.

In the second embodiment, the exhaust manifold 104 is provided to be common to the two nozzle arrays 102. Accordingly, the amount of the ink to be exhausted from the head unit 101 for the purpose of exhausting the mix color ink can be made to be small, as compared with a case of providing individual exhaust manifolds for the two nozzle arrays 102, respectively.

[Modifications]

Although the first and second embodiments of the present disclosure have been explained in the foregoing, the present disclosure is not limited to or restricted by the above-described embodiments; it is allowable to make a various kind of changes to the present disclosure, within the scope described in the claims.

In the head unit 11 of the first embodiment, the supply throttle channel 46 and the exhaust throttle channel 47, which correspond to the nozzle array 9 on the upstream side in the conveyance direction, are connected, respectively, to the downstream-side ends in the conveyance direction and the upstream-side ends in the conveyance direction of the pressure chambers 40. Further, the supply throttle channel 46 and the exhaust throttle channel 47, which correspond to the nozzle array 9 on the downstream side in the conveyance direction, are connected, respectively, to the upstream-side ends in the conveyance direction and the downstream-side ends in the conveyance direction of the pressure chambers 40. The present disclosure, however, is not limited to this configuration. It is allowable that connecting positions at which the supply throttle channel and exhaust throttle channel, which correspond to any one of the nozzle arrays 9 in the head unit 11, are connected respectively to the pressure chambers 40 may be reverse to those in the first embodiment.

Further, in the first and second embodiments, although the wiping is performed by moving the ink-jet head so that the ink-jet head and the wiper are moved relative to each other, the present disclosure is not limited to this. It is allowable to perform the wiping by moving the wiper, or by moving both of the ink-jet head and the wiper, so that the ink-jet head and the wiper are moved relative to each other.

Furthermore, in the first and second embodiments, the wiping is formed by moving the ink-jet head and the wiper relative to each other in a direction parallel to the alignment direction of the nozzles 10 forming each of the nozzle arrays, the present disclosure is not limited to this. It is allowable to perform the wiping by moving the ink-jet head and the wiper relative to each other in a direction crossing the alignment direction of the nozzles 10 forming each of the nozzle arrays.

Moreover, in the second embodiment, the exhaust manifold 104 is provided to be common to the two nozzle arrays 102, the present disclosure is not limited to this. It is allowable to provide exhaust manifolds individually for the two nozzle arrays 102, respectively. Also in such a case, it is possible to make the amount of the ink to be exhausted from the head unit 101 for the purpose of exhausting the mix color ink to be small, as compared with a case of performing the purge again in a state that both of the supply side and exhaust side valves 107 and 108 are opened.

Although in the second embodiment, in the case that there is a possibility that the mix color ink has inflowed into the individual channels 48, the purge is performed again in the state that the supply side valves 107 are closed while the exhaust side valve 108 is allowed to be opened, the present disclosure is not limited to this. In the second embodiment, it is allowable to perform the purge again in a state that both of the supply side valves 107 and the exhaust side valve 108 are opened.

Further, although in the first embodiment, in the case that there is a possibility that the mix color ink has inflowed into the individual channels 48, the purge is performed again in the state that both of the supply side valves 57 and the exhaust side valves 58 are opened, the present disclosure is not limited to this. In the first embodiment, it is allowable to perform the purge again in a state that the supply side valves 57 are closed and that the exhaust side valves 58 are opened.

Furthermore, in the first and second embodiments, it is allowable that, after the circulation of each of the inks is resumed, the processing may be ended without performing the determination as to whether or not the mix color ink has inflowed into the individual channels 48.

Moreover, in the first and second embodiments, although the large drop is discharged from each of the nozzles 10 in the discharge flushing, the present disclosure is not limited to this. In the discharge flushing, the medium drop or the small drop may be discharged. Alternatively, the volume of the ink discharged from each of the nozzles 10 during the discharge flushing may be different from the volume of the ink discharged from each of the nozzles 10 during the recording. For example, it is allowable that the volume of the ink to be discharged, during the discharge flushing, may be further greater than the volume of the large drop.

Further, in the first and the second embodiments, although the ink is discharged, in the discharge flushing, in the volume not less than half the volume of the sphere of which diameter is same as the diameter of each of the nozzles 10, the present disclosure is not limited to this. It is allowable to discharge the ink, in the discharge flushing, in a volume less than half the volume of the above-described sphere.

Further, in the first and the second embodiments, the ink tank is located at the position above the ink-jet head 2. Therefore, in the state that the supply-side and exhaust-side pumps are stopped and that the supply-side and exhaust-side valves are opened, the pressure in the ink inside the nozzles 10 becomes the positive pressure due to the difference in the water head pressure between the ink inside the ink tank and the ink inside the nozzles. Further, it is configured that, in a case of circulating each of the inks between the ink tank and the head unit, the supply-side and exhaust-side pumps are controlled to thereby allow the pressure in each of the nozzles 10 to be the negative pressure. However, the present disclosure is not limited to these.

Figure 9:
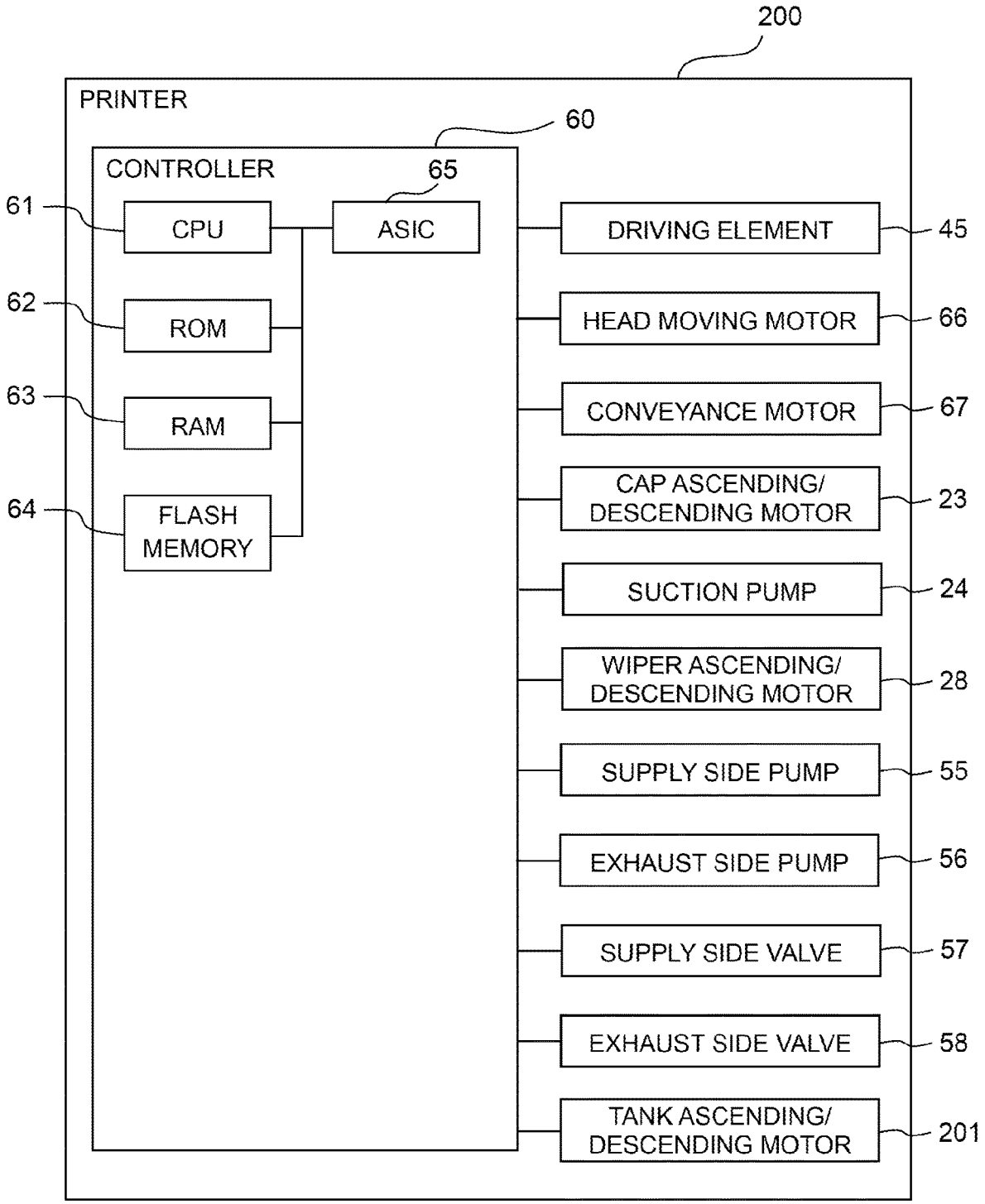
FIG. 9 is a block diagram depicting the electrical configuration of a printer according to a modification.

In a modification, as depicted in FIG. 9, a printer 200 is provided with, in addition to the configuration similar to that of the printer 1 of the first embodiment, a tank ascending/descending motor 201 (an example of a "second motor" of the present disclosure). In the printer 200, an ink tank 59 (see FIG. 3) is supported to be movable in the up-down direction; in a case that the tank ascending/descending motor 201 is driven, the ink tank 59 is moved in the up-down direction.

Further, in this modification, in a case that each of the inks is circulated between the ink tank 59 and the head unit 11, there is provided a state that the ink tank 59 is located at a position below or under the ink-jet head 2 by approximately tens of mm. With this, the pressure in the ink inside the nozzles 10 becomes the negative pressure due to the difference in the water head pressure between the ink inside the ink tank 59 and the ink inside the nozzles 10. Note that in this case, the supply side pumps 55 and the exhaust side pumps 56 are driven such that the pressure in the ink inside each of the nozzles 10 is not reversed from the negative pressure to the positive pressure due to the pressures imparted by the supply side pumps 55 and the exhaust side pumps 56.

Figure 10:
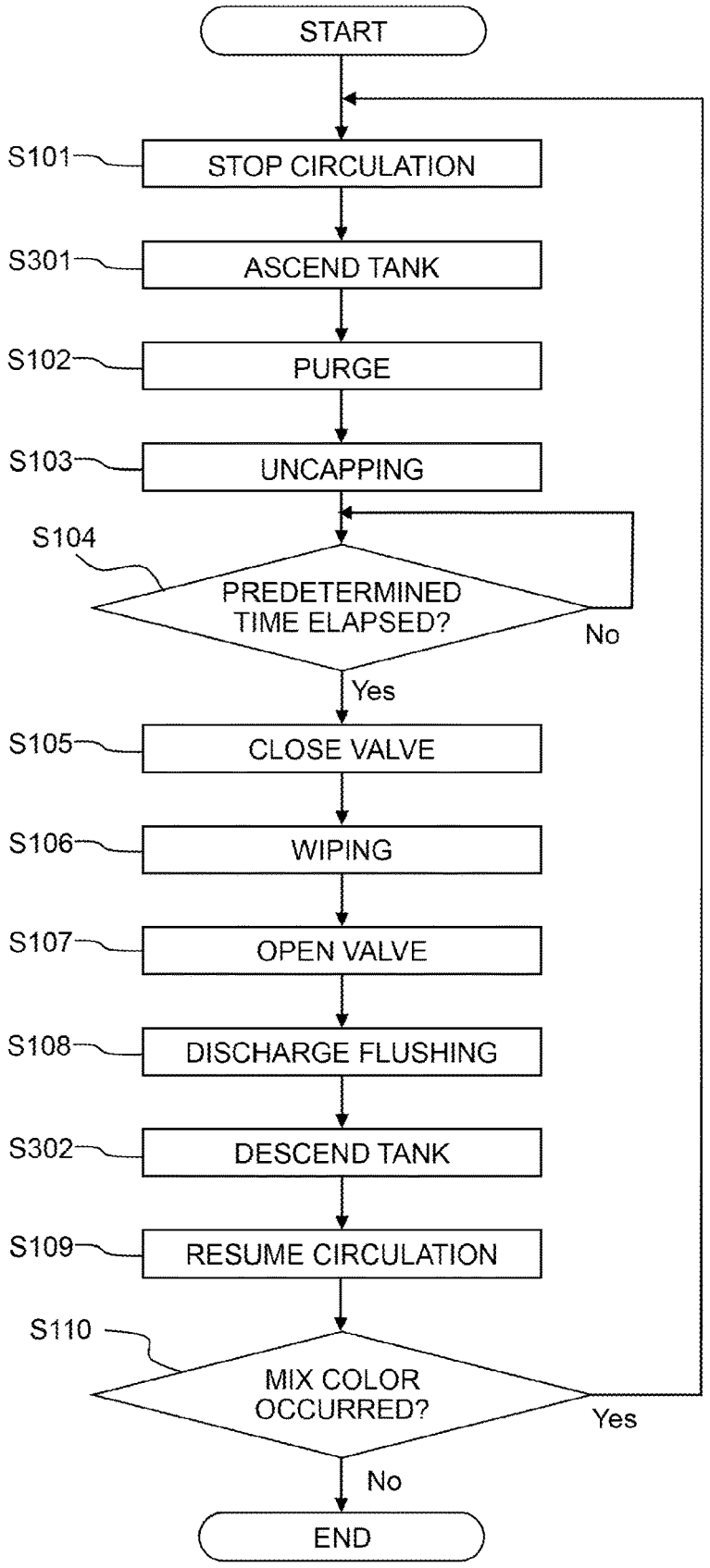
FIG. 10 is a flow chart depicting a flow of a processing in a case of performing maintenance in the modification.

Furthermore, in a case that the maintenance is performed, the controller 60 performs the processing in accordance with a flow depicted in FIG. 10. To provide more specific explanation, the controller 60 stops the circulation (S101), then the controller 60 drives the tank ascending/descending motor 201 so as to move each of the ink tanks 59 to a location above the ink-jet head 2 by approximately tens of mm (S301), and then the controller 60 performs the processing of each of steps S102 to S108 similarly to the first embodiment. With this, the wiping and the discharge flushing are performed in a state that the ink inside each of the nozzles 10 has the positive pressure due to the difference in the water head pressure between the ink inside one of the ink tanks 59 and the ink inside the nozzles 10.

Moreover, after the discharge flushing in step S108, the controller 60 drives the tank ascending/descending motor 201 so as to move each of the ink tanks 59 to the location below the ink-jet head 2 by approximately tens of mm (S302), and then the controller 60 resumes the circulation (S109).

Then, in a case that the controller 60 determines that there is not such a possibility that the mix color ink has flowed into the individual channels 48 (S110:NO), the controller 60 ends the processing. On the other hand, in a case that the controller 60 determines that there is such a possibility that the mix color ink has inflowed into the individual channels 48 (S110: YES), the controller 60 returns the procedure to step S101.

Note that in the modification, the pressure in the ink inside the nozzles 10 is switched between the positive pressure and the negative pressure by ascending and descending each of the ink tanks 59 in the printer of the first embodiment; it is allowable that, in the printer of the second embodiment, the pressure in the ink inside the nozzles 10 is switched between the positive pressure and the negative pressure by ascending and descending the ink tank 109. Further, it is allowable to switch the pressure in the ink inside the nozzles 10 between the positive pressure and the negative pressure by ascending and descending both of the ink tank(s) and the ink-jet head. Note that, however, in order to ascend and descend the ink-jet head, a mechanism for retracting the platen, etc., is required such that the platen, etc., does not hinder the movement of the ink-jet head. In view of this, it is more preferred to ascend and descend only the ink tank(s).

Further, although in the first and second embodiments, the wiping and the discharge flushing are performed in the state that the pressure in the ink in the nozzles 10 is made to be the positive pressure, the present disclosure is not limited to this. It is allowable to perform the wiping in a state that the pressure in the ink inside the nozzles 10 is made to be 0 (zero) or the negative pressure. Alternatively, it is allowable to perform the discharge flushing in the state that the pressure in the ink inside the nozzles 10 is made to be 0 (zero) or the negative pressure.

Furthermore, although in the first and second embodiments, the pressure in the ink inside the nozzles 10 is made to be the negative pressure in a case that the ink is circulated between the ink tank(s) and the head unit, the present disclosure is not limited to this. It is allowable to make the pressure in the ink inside the nozzles 10 to be 0 (zero) or the positive pressure in a case that the ink is circulated between the ink tank(s) and the head unit.

Moreover, although in the first and second embodiments, the wiping is performed in the state that all the supply side and exhaust side valves corresponding to all the nozzle arrays 9 in the head unit are closed, the present disclosure is not limited to this. For example, since the color of the black ink is hardly changed even if the black ink is mixed with the yellow ink, it is allowable that, during the wiping, the supply side and exhaust side valves corresponding to the nozzle array 9 formed of the nozzles 10 jetting the black ink may be remained to be opened.

Further, in the above-described examples, although the supply side and exhaust side valves are provided on the head unit and the wiping is performed in the state that both of the supply side and exhaust side valves are closed, the present disclosure is not limited to this. It is allowable to perform the wiping in a state that only the supply side valve(s) are closed. Furthermore, among the supply side and exhaust side valves, it is allowable that only the supply side valve(s) is provided on the head unit, and that the wiping is performed in a state that the supply side valve(s) is closed.

Moreover, in the above-described examples, although the discharge flashing is performed after the wiping, the present disclosure is not limited to this. It is allowable that the discharge flushing is not performed, after the wiping.

Further, in the above-described examples, the case of performing the wiping after the purge has been explained. However, the present disclosure is not limited to this. For example, in a case that the ink is jetted from the nozzles in order to perform recording on a recording paper sheet in the printer, the mist of the ink is generated and adheres to the jetting surface. Further, as the number of the recording paper sheets on which the recording is performed is increased, the amount of the mist adhered to the jetting surface becomes greater. In view of this, for example, it is allowable to perform the wiping every time the recording is performed for a predetermined number of the recording paper sheet. Regarding such a wiping also, the wiping is performed in a state that the supply side and exhaust side valves are closed, thereby making it possible to provide the situation wherein the mix color ink is less likely to flow into the individual channels.

Further, in the first and second embodiments, although the purge is performed by driving the supply side and exhaust side pumps, the present disclosure is not limited to this. For example, it is allowable to perform a suction purge for causing the ink(s) inside the head unit 11 to be exhausted, by driving the suction pump 24 in a state that the nozzles 10 of the head unit 11 are covered by the cap 10. In this case, a combination of the cap unit 6 and the suction pump 24 is an example of the "purge mechanism" of the present disclosure.

Furthermore, in the first and second embodiments, although the nozzles jetting the two color inks, respectively, are arranged in the head unit 2, the present disclosure is not limited to this. For example, it is allowable that nozzles jetting four color inks, respectively, are arranged in the head unit.

Moreover, although the foregoing explanation has been given about the case of applying the present disclosure to the printer provided with the ink-jet head configured to jet the plurality of color inks from the nozzles, the present disclosure is not limited to this. It is allowable, for example, to apply the present disclosure to a liquid jetting apparatus which is different from the printer and which is provided with a liquid jetting head configured to jet a plurality of kinds of liquids which are different from the ink, such as, for example, a liquefied metal, a resin, etc.

What is claimed is:

1. A liquid jetting apparatus comprising:

a liquid jetting head having:

a plurality of kinds of individual channels, a jetting surface formed with a plurality of kinds of nozzles, which are communicated with the plurality of kinds of individual channels respectively, and from which a plurality of kinds of liquids being jetted respectively, a plurality of kinds of inflow channels via which the plurality of kinds of liquids inflow into the plurality of kinds of individual channels, respectively, a plurality of kinds of outflow channels via which the plurality of kinds of liquids flow out of the plurality of kinds of individual channels, respectively;

valves provided at least on the plurality of kinds of inflow channels, respectively, among the plurality of kinds of inflow channels and the plurality of kinds of the outflow channels;

a wiper which is configured to be movable relative to the liquid jetting head in a direction along the jetting surface;

a first motor configured to move the liquid jetting head and the wiper relative to each other; and a controller, wherein the controller is configured to execute a wiping by driving the first motor in a state that all of the valves are closed; and in the wiping, the liquid jetting head and the wiper are moved relative to each other in a state that the wiper makes contact with the jetting surface.

2. The liquid jetting apparatus according to claim 1, further comprising a purge mechanism configured to perform a purge of causing the plurality of kinds of liquids inside the liquid jetting head to be discharged from the plurality of kinds of nozzles, respectively, wherein the controller is configured to execute the purge and then to execute the wiping.

3. The liquid jetting apparatus according to claim 2, wherein the purge mechanism has a pump provided at least one of a location which is on a side opposite to the plurality of kinds of individual channels with respect to the plurality of kinds of inflow channels, and a location which is on a side opposite to the plurality of kinds of individual channels with respect to the plurality of kinds of outflow channels.

4. The liquid jetting apparatus according to claim 3, wherein the pump is provided on the side opposite to the plurality of kinds of individual channels with respect to the plurality of kinds of inflow channels and on the side opposite to the plurality of kinds of individual channels with respect to the plurality of kinds of outflow channels, the valves are provided on both of the plurality of kinds of inflow channels and the plurality of kinds of outflow channels, the controller is configured to determine, after the wiping, whether a mix liquid, in which the plurality of kinds of liquids jetted from the plurality of kinds of nozzles of the plurality of kinds of individual channels are mixed, has inflowed into the plurality of kinds of individual channels, and in a case that the controller determines that the mix liquid has inflowed into the plurality of kinds of individual channels, the controller is configured to cause the purge mechanism to perform the purge in a state that the valves provided on the plurality of kinds of inflow channels and the valves provided on the plurality of kinds of outflow channels are both opened.

5. The liquid jetting apparatus according to claim 3, wherein the pump is provided at least on the location which is on the side opposite to the plurality of kinds of individual channels with respect to the plurality of kinds of outflow channels;

the valves are provided on both of the plurality of kinds of inflow channels and the plurality of kinds of outflow channels, the controller is configured to determine, after the wiping, whether a mix liquid, in which the plurality of kinds of liquids jetted from the plurality of kinds of nozzles of the plurality of kinds of individual channels are mixed, has inflowed into the plurality of kinds of individual channels, and in a case that the controller determines that the mix liquid has inflowed into the plurality of kinds of individual channels, the controller is configured to cause the purge mechanism to perform the purge in a state that the valves provided on the plurality of kinds of inflow channels are closed and that the valves provided on the plurality of kinds of outflow channels are opened.

6. The liquid jetting apparatus according to claim 5, wherein each of the plurality of kinds of nozzles include nozzles which are aligned to form a first nozzle array extending along a first direction, and nozzles which are aligned to form a second nozzle array extending along the first direction and arranged side by side to the first nozzle array in a second direction orthogonal to the first direction, each of the plurality of kinds of inflow channels includes a first inflow channel which is provided for the first nozzle array, and a second inflow channel which is provided for the second nozzle array; and each of the plurality of kinds of outflow channels is provided common to the first nozzle array and the second nozzle array, and arranged between the first and second inflow channels in the second direction.

7. The liquid jetting apparatus according to claim 1, wherein the controller is configured to execute, after the wiping, a discharge flushing of causing the plurality of kinds of liquids to be discharged respectively from the plurality of kinds of nozzles, by driving the liquid jetting head in a state that the valves are opened.

8. The liquid jetting apparatus according to claim 7, further comprising a pump configured to adjust pressure applied to the plurality of kinds of liquids inside the plurality of kinds of nozzles, wherein the controller is configured to control the pump to execute the discharge flushing in a state that the pressure applied to the plurality of kinds of liquids inside the plurality of kinds of nozzles is made to be positive pressure.

9. The liquid jetting apparatus according to claim 7, further comprising:

a plurality of kinds of liquid tanks which are connected to the plurality of kinds of inflow channels and the plurality of kinds of outflow channels, respectively, and which are configured to be movable in an up-down direction relative to the liquid jetting head; and a second motor configured to move the liquid jetting head and the plurality of kinds of liquid tanks relative to each other, wherein the controller is configured to drive the second motor to move the liquid jetting head and the plurality of kinds of liquid tanks relative to each other so that the liquid jetting head is located below the plurality of liquid tanks, to thereby make the pressure applied to the plurality of kinds of liquids inside the plurality of kinds of nozzles to be positive pressure, and then to execute the discharge flushing.

10. The liquid jetting apparatus according to claim 7, wherein the controller is configured to cause, in the discharge flushing, the liquid jetting head to discharge the plurality of kinds of liquids from the plurality of kinds of nozzles, respectively, and a volume of each of the plurality of kinds of liquids to be discharged from one of the plurality of kinds of nozzles in the discharge flushing is not less than half a volume of a sphere of which diameter is same as diameter of each of the plurality of kinds of nozzles.

11. The liquid jetting apparatus according to claim 7, wherein in a case that the controller causes the plurality of kinds of liquids to be jetted onto a target, the controller is configured to cause the liquid jetting head to jet each of the plurality of kinds of liquids, from one of the plurality of kinds of nozzles, selectively in a volume among a plurality of kinds of mutually different volumes, and the controller is configured to cause, in the discharge flushing, the liquid jetting head to discharge each of the plurality of kinds of liquids from one of the plurality of kinds of nozzles in a greatest volume among the plurality of kinds of mutually different volumes.

12. The liquid jetting apparatus according to claim 1, wherein the valves are provided on both of the plurality of kinds of inflow channels and the plurality of kinds of the outflow channels; and the controller is configured to execute the wiping in a state that the valves provided on both the plurality of kinds of inflow channels and the plurality of kinds of outflow channels are closed.

13. The liquid jetting apparatus according to claim 12, further comprising a pump configured to adjust pressure in each of the plurality of kinds of liquids inside the plurality of kinds of nozzles; and after the controller drives the pump so as to make the pressure in each of the plurality of kinds of liquids inside the plurality of kinds of nozzles to be positive pressure, the controller is configured to execute the wiping in the state that the valves provided on both the plurality of kinds of inflow channels and the plurality of kinds of outflow channels are closed.

14. The liquid jetting apparatus according to claim 13, wherein the pump includes:

positive pressure pumps which are configured to impart the positive pressure and which are provided on parts, of the plurality of kinds of inflow channels, located on a side opposite to the plurality of kinds of individual channels with respect to the valves, and negative pressure pumps which are configured to impart negative pressure and which are provided on parts, of the plurality of kinds of outflow channels, located on a side opposite to the plurality of kinds of individual channels with respect to the valves;

the liquid jetting apparatus is configured to make the pressure applied to the plurality of kinds of liquids inside the plurality of kinds of nozzles to be the positive pressure in a state that the valves are opened and that the positive pressure pumps and the negative pressure pumps are not driven;

the controller is configured to drive the positive pressure pumps and the negative pressure pumps in a state that the valves are opened so as to cause the plurality of kinds of liquids to inflow from the plurality of kinds of inflow channels into the plurality of kinds of individual channels, respectively, and to cause the plurality of kinds of liquids to flow out of the plurality of kinds of individual channels into the plurality of kinds of outflow channels, respectively; and the controller is configured to stop the driving of the positive pressure pumps and the negative pressure pumps in the state that the valves are opened so as to make the pressure applied to the plurality of kinds of liquids inside the plurality of nozzles to be the positive pressure, and then to perform the wiping in a state that the valves provided on the plurality of kinds of inflow channels and the valves provided on the plurality of kinds of outflow channels are closed.

15. The liquid jetting apparatus according to claim 14, wherein the controller is configured to drive the positive pressure pumps and the negative pressure pumps in the state that the valves are opened so that the pressure applied to the plurality of kinds of liquids inside the plurality of kinds nozzles is made to be the negative pressure, to thereby cause the plurality of kinds of liquids to inflow from the plurality of kinds of inflow channels into the plurality of kinds of individual channels, respectively, and to cause the plurality of kinds of liquids to flow out of the plurality of kinds of individual channels into the plurality of kinds of outflow channels, respectively.

16. The liquid jetting apparatus according to claim 12, further comprising:

a plurality of kinds of liquid tanks each of which is connected to one of the plurality of kinds of inflow channels and one of the plurality of kinds of outflow channels, and which are configured to be movable in an up-down direction relative to the liquid jetting head; and a second motor configured to move the liquid jetting head and the plurality of kinds of liquid tanks relative to each other, wherein the controller is configured to drive the second motor to move the liquid jetting head and the plurality of kinds of liquid tanks relative to each other so that the liquid jetting head is located below the plurality of kinds of liquid tanks, to thereby make the pressure applied to the plurality of kinds of liquids inside the plurality of kinds of nozzles to be positive pressure, and then to execute the wiping in the state that the valves provided on the plurality of kinds of inflow channels and the valves provided on the plurality of kinds of outflow channels are both closed.

17. The liquid jetting apparatus according to claim 16, wherein in a case that the controller causes the plurality of kinds of liquids to inflow from the plurality of kinds of inflow channels into the plurality of kinds of individual channels, respectively, and causes the plurality of kinds of liquids to flow out of the plurality of kinds of individual channels into the plurality of kinds of outflow channels, respectively, the controller is configured to drive the second motor to move the liquid jetting head and the plurality of kinds of liquid tanks relative to each other so that the liquid jetting head is located below the plurality of kinds of liquid tanks, to thereby make the pressure applied to the plurality of kinds of liquids inside the plurality of kinds of nozzles to be negative pressure.

18. The liquid jetting apparatus according to claim 1, wherein the controller is configured to execute the wiping in a state that the valves, corresponding to all of the plurality of kinds of liquids which are jetted from the plurality of kinds of nozzles, respectively, are closed.

19. The liquid jetting apparatus according to claim 1, wherein the plurality of kinds of liquids includes a first liquid and a second liquid;

the plurality of kinds of nozzles include nozzles which are aligned to form a first nozzle array extending along a first direction and which jet the first liquid, and nozzles which are aligned to form a second nozzle array extending along the first direction and arranged side by side to the first nozzle array in a second direction orthogonal to the first direction, and which jet the second liquid, and the first motor is configured to move the liquid jetting head and the wiper relative to each other in the first direction.

20. The liquid jetting apparatus according to claim 1, wherein the plurality of kinds of liquids includes a first liquid and a second liquid;

the plurality of kinds of nozzles include nozzles which are aligned to form a first nozzle array extending along a first direction and which jet the first liquid, and nozzles which are aligned to form a second nozzle array extending along the first direction and arranged side by side to the first nozzle array in a second direction orthogonal to the first direction, and which jet the second liquid, the plurality of kinds of inflow channels include a first inflow channel corresponding to the first nozzle array, and a second inflow channel corresponding to the second nozzle array, the plurality of kinds of outflow channels include a first outflow channel corresponding to the first nozzle array, and a second outflow channel corresponding to the second nozzle array, in the second direction, the first inflow channel is located on a side of the second nozzle array with respect to the first outflow channel, and in the second direction, the second inflow channel is located on a side of the first nozzle array with respect to the second outflow channel.

* * * * *